US009711119B2

(12) United States Patent
Sato

(10) Patent No.: US 9,711,119 B2
(45) Date of Patent: Jul. 18, 2017

(54) AUDIO PROCESSING DEVICE, METHOD OF AUDIO PROCESSING, STORAGE MEDIUM, AND ELECTRONIC MUSICAL INSTRUMENT

(71) Applicant: CASIO COMPUTER CO., LTD., Tokyo (JP)

(72) Inventor: Hiroki Sato, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/377,898

(22) Filed: Dec. 13, 2016

(65) Prior Publication Data

US 2017/0169807 A1 Jun. 15, 2017

(30) Foreign Application Priority Data

Dec. 14, 2015 (JP) ..... 2015-243506

(51) Int. Cl.
*G10H 1/04* (2006.01)
*G10H 1/043* (2006.01)
*G10H 1/00* (2006.01)

(52) U.S. Cl.
CPC ..... *G10H 1/043* (2013.01); *G10H 1/0008* (2013.01); *G10H 2210/281* (2013.01); *G10H 2210/391* (2013.01)

(58) Field of Classification Search
CPC ..... G10H 1/043; G10H 1/0008; G10H 2210/281; G10H 2210/391
USPC ..... 84/612, 626, 630, 636
See application file for complete search history.

(56) References Cited

U.S. PATENT DOCUMENTS 4,218,874 A * 8/1980 Ishida ..... G04F 5/025 84/484
4,345,501 A * 8/1982 Nakada ..... G10H 1/26 84/612
4,402,244 A * 9/1983 Nakada ..... G10H 1/26 84/470 R
4,432,266 A * 2/1984 Nakada ..... G10H 1/36 84/478
4,843,935 A * 7/1989 Car-Lai ..... G10H 1/38 84/637

(Continued)

FOREIGN PATENT DOCUMENTS

JP H5-027752 A 2/1993
JP H5-94180 A 4/1993

(Continued)

*Primary Examiner* — David Warren
(74) *Attorney, Agent, or Firm* — Chen Yoshimura LLP

(57) ABSTRACT

A delay time counter in a DSP cyclically counts a sampling clock from zero to a delay time sampling count and issues a delay time interrupt to a CPU each time the sampling clock count reaches the delay time sampling count. The CPU measures a time difference between each time the DSP issues the delay time interrupt and each time sequence clock interrupts occur a number of times corresponding to the delay time. Then, in order to reduce this time difference, the CPU increases or decreases a maximum count that is set to the sequence clock counter. Therefore, in the next delay process, the shift between the time by which the automatic performance is advanced by the CPU (which is equal to the delay time) and the timing of the delay process executed by the DSP (which is also equal in length to the delay time) will be corrected.

14 Claims, 20 Drawing Sheets

(56) References Cited

U.S. PATENT DOCUMENTS 5,027,686 A * 7/1991 Ishikawa ..... G04F 5/025 84/484
5,430,243 A * 7/1995 Shioda ..... G10H 1/0066 84/645
5,629,491 A * 5/1997 Usa ..... G10H 1/0066 84/612
5,663,514 A * 9/1997 Usa ..... G10H 1/0008 84/600
5,689,571 A * 11/1997 Kitamura ..... G10K 15/12 381/63
5,753,845 A * 5/1998 Nagata ..... G10H 1/0091 434/307 A
5,767,430 A * 6/1998 Yamanoue ..... G10H 1/0033 84/602
6,281,424 B1 * 8/2001 Koike ..... G10H 1/0066 84/636
6,331,851 B1 * 12/2001 Suzuki ..... G06F 17/30017 345/419
2002/0002898 A1 * 1/2002 Schmitz ..... G10H 1/0058 84/645
2003/0117531 A1 * 6/2003 Rovner ..... G10H 1/361 348/729
2004/0055444 A1 * 3/2004 Ishii ..... G10H 1/0041 84/604
2004/0136549 A1 * 7/2004 Pennock ..... G10H 1/02 381/119
2004/0196988 A1 * 10/2004 Moulios ..... G10H 1/0091 381/119
2005/0240396 A1 * 10/2005 Childs ..... G10H 1/0025 704/207
2007/0157798 A1 * 7/2007 Sako ..... G11B 27/11 84/611
2007/0163426 A1 * 7/2007 Eitaki ..... G10F 1/02 84/609
2007/0221046 A1 * 9/2007 Ozaki ..... A63F 13/00 84/612
2008/0072744 A1 * 3/2008 Ito ..... G10H 1/28 84/638
2008/0072745 A1 * 3/2008 Ito ..... G10H 1/28 84/638
2009/0235811 A1 * 9/2009 Komori ..... A63B 71/0686 84/636
2010/0017034 A1 * 1/2010 Nakadai ..... A63H 3/28 700/258
2014/0041513 A1 * 2/2014 Abesser ..... G10H 1/0008 84/622
2015/0040740 A1 * 2/2015 Setoguchi ..... G10H 1/18 84/603

FOREIGN PATENT DOCUMENTS

JP H6-083357 A 3/1994
JP 2011-215363 A 10/2011

* cited by examiner

| TEMPO_COUNT_TBL | | |
|---|---|---|
| TEMPO | DELAY_ COUNT | SEQ_CLOCK _COUNT |
| Tempo (BPM) | DPS sampling clock value when delay time is synchronized to one beat of specificed tempo (natural number) | CPU system clock count required for sequence clock interrupt corresponding to 1/480th of one beat of specified tempo (μsec) |
| 30 | 88200 | 4167 |
| 31 | 85355 | 4032 |
| 32 | 82688 | 3906 |
| 33 | 80182 | 3788 |
| 34 | 77824 | 3676 |
| 35 | 75600 | 3571 |
| ⋮ | ⋮ | ⋮ |
| 115 | 23009 | 1087 |
| 116 | 22810 | 1078 |
| 117 | 22615 | 1068 |
| 118 | 22424 | 1059 |
| 119 | 22235 | 1050 |
| 120 | 22050 | 1042 |
| 121 | 21868 | 1033 |
| 122 | 21689 | 1025 |
| 123 | 21512 | 1016 |
| 124 | 21339 | 1008 |
| 125 | 21168 | 1000 |
| ⋮ | ⋮ | ⋮ |
| 295 | 8969 | 424 |
| 296 | 8939 | 422 |
| 297 | 8909 | 421 |
| 298 | 8879 | 419 |
| 299 | 8849 | 418 |
| 300 | 8820 | 417 |

FIG. 5A

| Supplementary Data | | |
|---|---|---|
| Supp. Data 1 | Supp. Data 2 | Supp. Data 3 |
| Time required to sample DELAY_COUNT amount (msec) | Time difference between time required for DELAY_COUNT sampling and time required to count one beat worth of sequence clock interrupt (msec) | Time difference when 32 bars are played in a 4/4 time signature (msec) |
| 2000 | −0.16 | −20.48 |
| 1935.49 | 0.13 | 16.64 |
| 1875.01 | 0.13 | 16.64 |
| 1818.19 | −0.05 | −6.4 |
| 1764.72 | 0.24 | 30.72 |
| 1714.29 | 0.21 | 26.88 |
| ⋮ | ⋮ | ⋮ |
| 521.75 | −0.01 | −1.28 |
| 517.23 | −0.21 | −26.88 |
| 512.81 | 0.17 | 21.76 |
| 508.48 | 0.16 | 20.48 |
| 504.2 | 0.2 | 25.6 |
| 500 | −0.16 | −20.48 |
| 495.87 | 0.03 | 3.84 |
| 491.81 | −0.19 | −24.32 |
| 487.8 | 0.12 | 15.36 |
| 483.88 | 0.04 | 5.12 |
| 480 | 0 | 0 |
| ⋮ | ⋮ | ⋮ |
| 203.38 | −0.14 | −17.92 |
| 202.7 | 0.14 | 17.92 |
| 202.02 | −0.06 | −7.68 |
| 201.34 | 0.22 | 28.16 |
| 200.66 | 0.02 | 2.56 |
| 200 | −0.16 | −20.48 |

FIG. 5B

| SYNC_BEAT_TBL | | |
|---|---|---|
| Setting | NUMERATOR | DENOMINATOR |
| 0 | 1 | 4 |
| 1 | 1 | 3 |
| 2 | 1 | 2 |
| 3 | 2 | 3 |
| 4 | 1 | 1 |
| 5 | 3 | 2 |
| 6 | 2 | 1 |
| 7 | 3 | 1 |

FIG. 7A

| Supplementary Data | |
|---|---|
| Synchronization Beat Count | Synchronization Sequence Clock Count |
| 1/4 | 120 |
| 1/3 | 160 |
| 1/2 | 240 |
| 2/3 | 320 |
| 1 | 480 |
| 3/2 | 720 |
| 2 | 960 |
| 3 | 1440 |

FIG. 7B

| Variable (Sequence No.) | Sequence Member | Size | Range | Notes |
|---|---|---|---|---|
| TEMPO_COUNT_SEQ[301] Sequence: Tempo 0-300-029 not used | DELAY_COUNT | 32bit | 0~180000 | DPS sampling clock count when delay time is synchronized to one beat of specificed tempo |
| | SEQ_CLOCK_COUNT | 32bit | 0~4187 | CPU system clock count for one sequence clock corresponding to 1/480th of one beat of specified tempo |
| SYNC_BEAT_SEQ[8] Sequence: Setting 0-7 | NUMERATOR | 32bit | 1,1,1,2,1,3,5,3 | Numerator of synchronized beat count |
| | DENOMINATOR | 32bit | 4,3,2,3,1,2,4,1 | Denominator of synchronized beat count |

FIG. 9A

| Variable (Sequence No.) | Size | Range (****H = hex notation) | Start Value | Notes |
|---|---|---|---|---|
| TEMPO | 16bit | 30~300 | 120 | Set Tempo (BPM) |
| SEQ_RUN | 1bit | 0,1 | 0 | Is automatic performance being performed? 0...No 1...Yes |
| DELAY_HOLD | 1bit | 0,1 | 0 | Delay Hold Mode? 0...No 1...Yes |
| DELAY_SYNC | 1bit | 0,1 | 0 | Delay Tempo Synchorized Mode? 0...No 1...Yes |
| DELAY_TIME | 16bit | 0~FFFFH | - | Delay Time (1msec units) Set to value corresponding to initial knob location |
| DELAY_FEEDBACK | 16bit | 0~FFFFH | 0 | Delay feedback amount FFFF represents 1.0 (100%) |
| DELAY_LEVEL | 16bit | 0~FFFFH | 0 | Delay sound level FFFF represents 1.0 (100%) |
| DELAY_SYNC_BEAT | 3bit | 0~7 | - | Synchronized Beat Count Parameter (corresponding to synchronized beat count and sequence clock count) |
| SEQ_CLOCK | 32bit | 0~FFFFFFFFH | 0 | Sequence clock count value for controlling tempo of automatic performance |
| LAST_SEQ_CLOCK | 32bit | 0~FFFFFFFFH | 0 | SEQ_CLOCK value when CPU performs automatic performance last |
| LAST_DELAY_TIME | 32bit | 0~FFFFFFFFH | 0 | Free-running time when DSP performs delay time interrupt last |
| LAST_BEAT_TIME | 32bit | 0~FFFFFFFFH | 0 | Free-running time when determined that expected number of beats matching last delay time have passed |
| SYNC_SEQ_CLOCK | 16bit | 0~FFFFH | 0 | Incrementally increase sequence clock and counter for verifying synchronizaion of delay time interrupt and sequence clock, and reset to 0 at synchronized timing |
| SYNC_FLAG | 1bit | 0~1 | 0 | Set to 1 when either delay time interrupt close to synchronized timing or passage of CPU beats occurs, and reset to 0 when both events occur |

FIG. 9B

| Variable (Sequence No.) | Size | Range (****H = hex notation) | Start Value | Notes |
|---|---|---|---|---|
| CPU_FREE_TIMER | 32bit | 0-FFFFFFFF | 0 | Value of free-running time of CPU |
| CPU_TIMER_COUNT | 32bit | 0-FFFFFFFF | 0 | Setting value of CPU timer. Send interrupt and reset to 0 when value set here is counted. No operation at 0. |

FIG. 10A

| Variable (Sequence No.) | Size | Range (****H = hex notation) | Start Value | Notes |
|---|---|---|---|---|
| DSP_DELAY_SAMPLE | 16bit | 0-800000 | 0 | Delay Sampling Count Register (when written to, value is set in delay sampling counter and read pointer) |
| DSP_DELAY_INPUT | 16bit | 0-FFFFH | FFFFH | Delay Input Sound Adjustment Amp value (0 represents 0.0, FFFFH represents 1.0) |
| DSP_DELAY_OUTPUT | 16bit | 0-FFFFH | FFFFH | Delay Output Sound Adjustment Amp value (0 represents 0.0, FFFFH represents 1.0) |
| DSP_DELAY_FEEDBACK | 16bit | 0-FFFFH | FFFFH | Delay Output Feedback Adjustment Amp value (0 represents 0.0, FFFFH represents 1.0) |
| DSP_DELAY_INIT | 1bit | 0,1 | 0 | Writing 1 initializes delay memory, pointer, etc. |

FIG. 10B

AUDIO PROCESSING DEVICE, METHOD OF AUDIO PROCESSING, STORAGE MEDIUM, AND ELECTRONIC MUSICAL INSTRUMENT

BACKGROUND OF THE INVENTION

Technical Field

The present invention relates to an audio processing device for synchronizing processes between two audio processors, a method of audio processing, a storage medium, and an electronic musical instrument that uses the audio processing device.

Background Art

In audio effects devices that are built into electronic musical instruments and have a delay feature for applying an echo effect to an input signal, there is a conventionally well-known technology known as tempo synchronization delay that automatically sets a delay time according to the tempo setting of an automatic performance (accompaniment, sequencer, arpeggio, or the like) of the electronic musical instrument such that the delay signal is synchronized with the rhythm of the music (the technology disclosed in Patent Document 1, for example). There are also well-known conventional technologies in which even if a song is currently being played, the content of an effect process is changed if an operation for changing the tempo of the performance is performed (the technology disclosed in Patent Document 2, for example).

When using a tempo synchronization delay feature, setting the delay time to a multiple of one beat such as 1/4 beat, 1/3 beat, 1/2 beat, 2/3 beat, 1 beat, 3/2 beats, 2 beats, or 3 beats, for example, makes it possible to produce an echo effect that coordinates better with the music. Furthermore, there is also a conventionally well-known feature known as a sample looper that uses this delay feature to repeatedly play back the same performance.

Patent Document 1: Japanese Patent Application Laid-Open Publication No. H5-94180

Patent Document 2: Japanese Patent Application Laid-Open Publication No. 2011-215363

However, in conventional tempo synchronized delay features, the delay time is not actually completely synchronized with the tempo of the automatic performance due to discretization of delay time and/or the tempo with a clock or clocks, which are the minimum time units that can be handled in digital data processing. As a result, the discretized delay time is set such that it is synchronized with the tempo (which may also be discretized) within a permissible range. Therefore, strictly speaking, the delay time is actually slightly shifted from the tempo. This shift will generally not be perceived if the amount of feedback in the delay is small or if the repeat count is relatively low. However, if the delay feedback amount is large, the repeat count is high, or the feature is used to implement a sample looper that repeatedly plays back the same performance with the feedback set to 100%, the shift accumulates during each repetition until the error is magnified enough to be audible to the human ear.

The present invention therefore aims to make it possible to correct this shift in timing in automatic performance processes and audio effect processes. Accordingly, the present invention is directed to a scheme that substantially obviates one or more of the problems due to limitations and disadvantages of the related art.

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an audio processing device, including: a first processor that cyclically counts a sampling clock to a first count value, and outputs an audio effect sound generated by processing a received audio waveform signal each time the count of the sampling clock reaches the first count value; and a second processor that cyclically counts a sequence clock to a second count value, and causes a corresponding segment of a preset music to be played each time the count of the sequence clock reaches the second count value so as to perform an automatic play of the preset music, wherein each time the count of the sampling clock reaches the first value, the first or second processor, or a separate circuit unit in the audio processing device detects a time difference between a time at which the count of the sampling clock reaches the first count value and a time at which the count of the sequence clock reaches the second count value a number of times corresponding to the time at which the count of the sampling clock reaches the first count value, and adjusts the second count value for a subsequent cycle of counting in accordance with the detected time difference so as to reduce the detected time difference, thereby providing synchronization of the output of the audio effect sound with the automatic play of the preset music over time.

In another aspect, the present disclosure provides a method of audio processing used in an audio processing device having a first processor and a second processor, the method including: causing the first processor to: cyclically count a sampling clock to a first count value, and output an audio effect sound generated by processing a received audio waveform signal each time the count of the sampling clock reaches the first count value; causing the second processor to: cyclically count a sequence clock to a second count value, and cause a corresponding segment of a preset music to be played each time the count of the sequence clock reaches the second count value so as to perform an automatic play of the preset music; and each time the count of the sampling clock reaches the first value, causing the first or second processor, or a separate circuit unit in the audio processing device to: detect a time difference between a time at which the count of the sampling clock reaches the first count value and a time at which the count of the sequence clock reaches the second count value a number of times corresponding to the time at which the count of the sampling clock reaches the first count value, and adjust the second count value for a subsequent cycle of counting in accordance with the detected time difference so as to reduce the detected time difference, thereby providing synchronization of the output of the audio effect sound with the automatic play of the preset music over time.

In another aspect, the present disclosure provides a non-transitory computer-readable storage medium having stored therein a program executable by an audio processing device having a first processor operating under a sampling clock and a second processor operating under a sequential clock, the program controlling the audio processing device to perform the following: causing the first processor to: cyclically count the sampling clock to a first count value, and output an audio effect sound generated by processing a received audio waveform signal each time the count of the sampling clock reaches the first count value; causing the second processor to: cyclically count the sequence clock to a second count value, and cause a corresponding segment of a preset music to be played each time the count of the sequence clock reaches the second count value so as to perform an automatic play of the preset music; and each time the count of the sampling clock reaches the first value, causing the first or second processor, or a separate circuit unit in the audio processing device to: detect a time difference between a time at which the count of the sampling clock reaches the first count value and a time at which the count of the sequence clock reaches the second count value a number of times corresponding to the time at which the count of the sampling clock reaches the first count value, and adjust the second count value for a subsequent cycle of counting in accordance with the detected time difference so as to reduce the detected time difference, thereby providing synchronization of the output of the audio effect sound with the automatic play of the preset music over time.

In another aspect, the present disclosure provides an electronic musical instrument, including: a sound emitting unit that receives an audio waveform signal supplied from an input unit and repeatedly emits, at a prescribed timing, an audio effect sound generated by processing the audio waveform signal, the sound emitting unit further outputting musical notes of a preset music stored in a storage unit to perform an automatic play of the preset music; and a controller that changes, in accordance with the prescribed timing at which the audio effect sound is emitted by the sound emitting unit, playback timing and speed of the automatic play of the preset music by the sound emitting unit.

It is to be understood that both the foregoing general description and the following detailed description are exemplary and explanatory, and are intended to provide further explanation of the invention as claimed.

BRIEF DESCRIPTION OF THE DRAWINGS

The detailed descriptions below are intended to be read with reference to the following figures in order to gain a deeper understanding of the present application.

FIG. 4A is a functional block diagram of the delay process executed by the DSP 206 of the sound source LSI 204; FIG. 4B is an explanatory drawing of the delay device 401 illustrated in FIG. 4A; and FIG. 4C is the delay ring buffer memory when the write pointer 410 and the read pointer 411 specify the ending address 414 and the next address.

FIGS. 5A and 5B respectively illustrate an example of the data configurations of a tempo-count table (TEMPO_COUNT_TBL) and a supplementary data table.

FIGS. 7A and 7B respectively illustrate an example of the data configurations of a synchronization beat count table (SYNC_BEAT_TBL) and a supplementary data table.

FIGS. 9A and 9B respectively illustrate an example of the configurations of data stored in a CPU ROM 202 and a CPU RAM 203.

FIGS. 10A and 10B respectively illustrates an example of the data configurations of registers in the CPU 201 and the DSP 206.

DETAILED DESCRIPTION OF EMBODIMENTS

Figure 1:
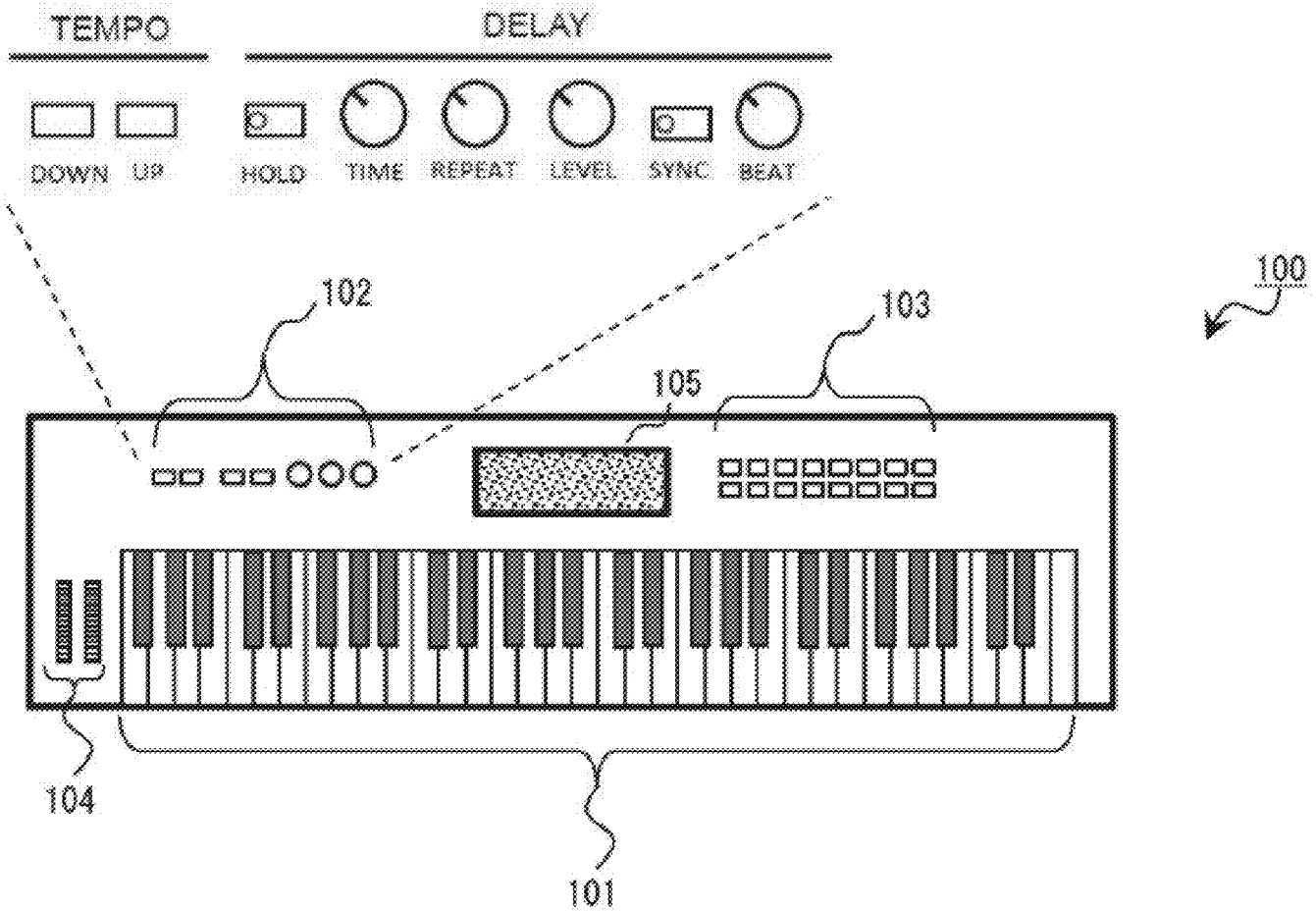
FIG. 1 is an external view of an embodiment of an electronic keyboard 100 according to the present invention.

The inability to completely synchronize the delay time of a delay process (which is a type of audio effect process) to the tempo of an automatic performance (automatic play) in conventional technologies is due to the following reasons. First, the automatic performance control process that advances the automatic performance is typically executed by a central processing unit (CPU). The CPU implements a sequence clock counter that cyclically counts a hardware timer (that is, a system clock) from zero to a maximum sequence clock count that corresponds to a time obtained by dividing one beat of the specified tempo by a prescribed number (such as 480). This sequence clock counter issues a sequence clock interrupt each time the system clock count reaches the maximum sequence clock count. The CPU also executes the automatic performance control process, which advances the automatic performance in synchronization with these sequence clock interrupts. Meanwhile, the delay process is typically implemented by a digital signal processor (DSP) that executes a digital audio process using dedicated hardware and dedicated software. The DSP sets the delay time used in the delay process to a value such as 1/4 beat, 1/3 beat, 1/2 beat, 2/3 beat, 1 beat, 3/2 beats, 2 beats, or 3 beats, for example, such that the delay time is equal to a prescribed natural number multiple or a prescribed natural number fraction of one beat of the specified tempo. Here, the delay time can be given as a number of samples, which represents how many cycles of a sampling clock the delay time is equal to. The DSP sets the difference between a write address and a read address in a delay ring buffer memory that sequentially stores samples of an audio signal as this number of samples corresponding to the delay time. Then, the DSP delays the audio signal written to the delay ring buffer memory by the number of samples corresponding to the delay time and reads the result to produce a delay effect that is synchronized with the beats of the tempo. Here, the sampling clock in the DSP and the system clock in the CPU are generated using different oscillators, and therefore in conventional technologies, it was not possible to completely synchronize the delay time of the delay process with the tempo of the automatic performance. As a result, in conventional implementations of processes such as the so-called sample looper (in which an audio signal output by the delay process is fed back into the input such that the audio signal is repeatedly written and then read after a delay), the tempo of the automatic performance gets shifted from the tempo of the audio signal from the delay process, resulting in an unpleasant auditory experience.

The present embodiment makes it possible to synchronize the automatic performance control process in the CPU with the delay process in the DSP by adding a process synchronization unit that has features for a delay time interrupt generation process and a sequence clock correction process (the behavior of these processes will be described below) to a first or second audio processor, for example. One example of an embodiment makes it possible to change the playback speed of the musical notes in the automatic performance to match the timing at which audio effects (echo effects or the delay process) are played.

The delay time interrupt generation process is executed by the DSP, for example. First, the DSP implements a delay time counter that cyclically counts the sampling clock from zero to the delay time sampling count. This delay time counter issues a delay time interrupt to the CPU each time the sampling clock count reaches the delay time sampling count (which here is the maximum count).

Meanwhile, the sequence clock correction process is executed by the CPU, for example. In this process, the CPU measures the time difference between each instant or time the sequence clock interrupt is issued a number of times corresponding to the delay time and each instant or time the DSP issues the delay time interrupt. Then, in order to reduce this time difference, the CPU increases or decreases the maximum sequence clock count that is set to the sequence clock counter. Therefore, in the next delay process, the shift between the timing of the automatic performance (which is advanced by an amount equal to the delay time by the CPU) and the timing of the delay process (which has a length equal to the delay time in the DSP) will be removed.

Next, an embodiment of the present invention for implementing the feature described above will be described in detail with reference to figures. FIG. 1 is an external view of an embodiment of an electronic keyboard according to the present invention. The present embodiment is implemented as an electronic keyboard 100, which is an electronic musical instrument that includes a process synchronization device between audio processors (a CPU and a DSP). The electronic keyboard 100 includes: a keyboard 101 that includes a plurality of keys that function as musical controls for specifying the pitch of musical notes that should be played; a switch panel that includes feature selection controls 102 for specifying an effect feature that applies a delay effect (an example of an audio effect) to the musical notes and tone selection buttons 103 that function as tone selection controls for selecting a tone and as controls for selecting automatic performance features such as accompaniment, a sequencer, or auto-arpeggio; bender/modulation wheels 104 that add various types of modulation (performance effects) such as pitch bend, tremolo, and vibrato; a liquid crystal display (LCD) 105 that displays the tone and various settings other than the tone; and the like. The electronic keyboard 100 also includes, in a location such as the rear face, side face, or back face thereof, speakers (not illustrated in the figure) that emit the musical notes played during the performance.

As illustrated in FIG. 1, the feature selection controls 102 include an UP button and a DOWN button for specifying the tempo (TEMPO) and a HOLD button, a TIME knob, a REPEAT knob, a LEVEL knob, a SYNC button, and a BEAT knob for specifying the effect feature (DELAY) that applies the delay effect. These controls will be described in detail later.

Figure 2:
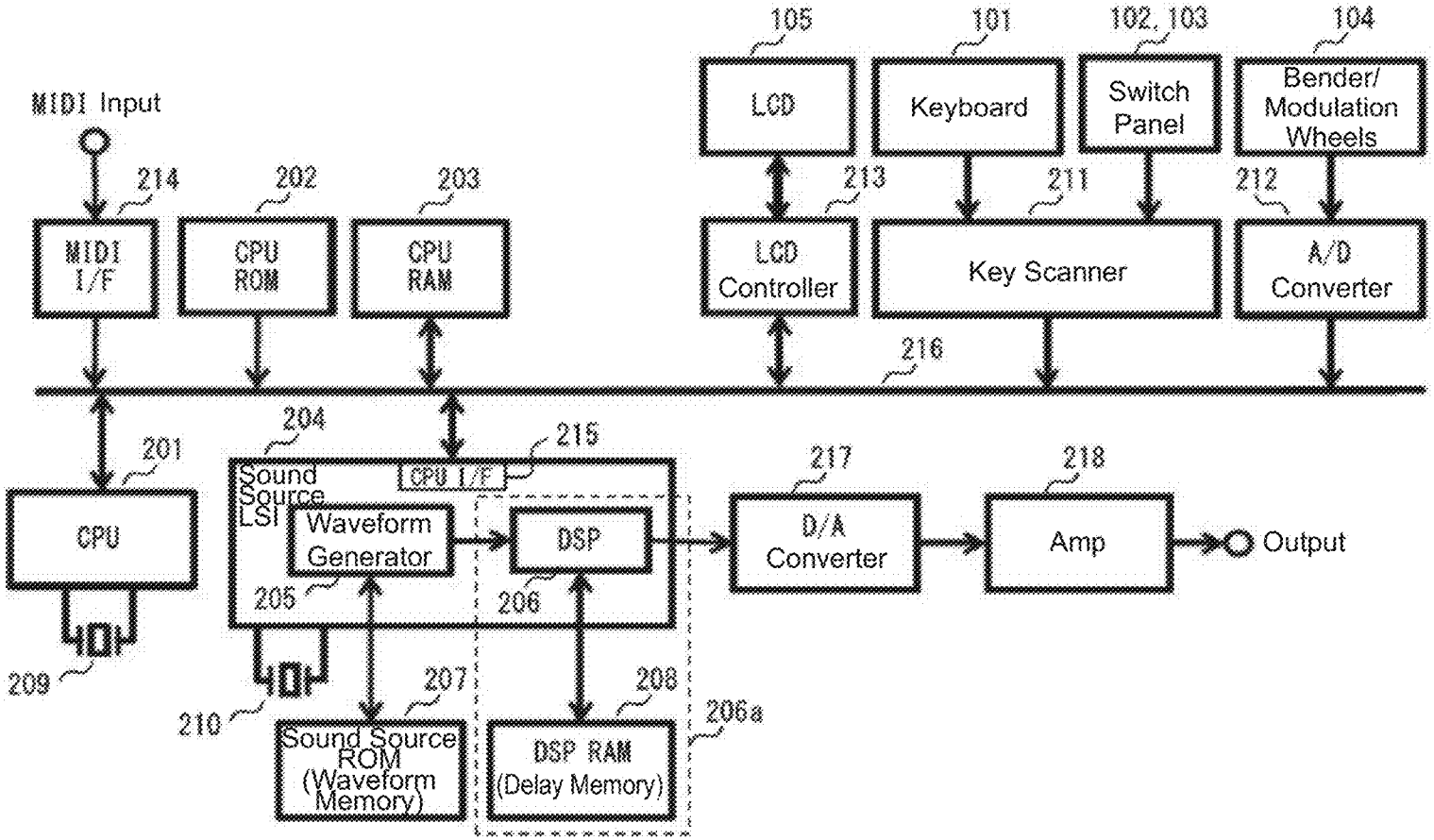
FIG. 2 illustrates an example of a hardware configuration for the embodiment of the electronic keyboard 100.

FIG. 2 illustrates an example of a hardware configuration for the embodiment of the electronic keyboard 100 illustrated in FIG. 1. As illustrated in FIG. 2, the electronic keyboard 100 has a configuration in which a central processing unit (CPU) 201, read-only memory (CPU ROM) 202, random-access memory (CPU RAM) 203, a sound source large-scale integrated circuit (LSI) 204, a key scanner 211, an A/D converter 212, and a Musical Instrument Digital Interface (MIDI I/F) 214 are connected to a system bus 216. An oscillator 209 that supplies the system clock is connected to the CPU 201, and an oscillator 210 that supplies the sampling clock is connected to the sound source LSI 204. The sound source LSI 204 includes a built-in waveform generator 205, DSP 206, and CPU I/F 215. A sound source ROM 207 (waveform memory) is connected to the waveform generator 205. A DSP RAM 208 (delay memory) is connected to the DSP 206. In the present embodiment, together the DSP 206 and the DSP RAM 208 form a first processor 206*a*. The keyboard 101 illustrated in FIG. 1 and the switch panel that includes the feature selection controls 102 and the tone selection buttons 103 illustrated in FIG. 1 are connected to the key scanner 211. The bender/modulation wheels 104 illustrated in FIG. 1 are connected to the A/D converter 212. The LCD 105 illustrated in FIG. 1 is connected to an LCD controller 213. The LCD controller 213 and the MIDI I/F 214 receive MIDI input. Furthermore, digital musical note waveform data output from the DSP 206 of the sound source LSI 205 is converted to an analog musical note waveform signal by a D/A converter 217, which is then amplified by an amplifier 218 and output from a speaker or an output terminal (not illustrated in the figure).

The CPU 201 controls the operation of the electronic keyboard 100 illustrated in FIG. 1 by executing control programs stored in the CPU ROM 202 while using the CPU RAM 203 as working memory. The CPU 201 receives performance instructions that are sent to the system bus 216 via the key scanner 211 or the A/D converter 212 from components such as the keyboard 101, the feature selection controls 102, the tone selection buttons 103, and the bender/modulation wheels 104 illustrated in FIG. 1. The CPU 201 also receives MIDI input that represents performance instructions from external devices (not illustrated in the figure) via the MIDI I/F 214. The CPU 201 then outputs, in accordance with these performance instructions, instructions for emitting/silencing musical notes, instructions for applying audio effects/delay effects, audio effect sounds generated by audio effect processes, and the like to the sound source LSI 204. The CPU 201 also outputs information such as instructions for emitting/silencing the musical notes of an automatic performance on the basis of automatic performance data stored in the CPU ROM 202.

In the present embodiment, the CPU 201 functions as a second processor.

The waveform generator 205 of the sound source LSI 204 loads musical note waveform data from the sound source ROM 207 (the waveform memory) according to the instructions for emitting/silencing musical notes from the CPU 201 and then supplies that data as an audio signal to the DSP 206.

The DSP 206 of the sound source LSI 204 applies a delay effect to the musical note waveform data input from the waveform generator 205 while using the DSP RAM 208 as delay memory and then outputs the resulting musical note waveform data to the D/A converter 217. The delay effect settings are configured by the CPU 201.

The CPU I/F 215 of the sound source LSI 204 processes the various types of data and interrupt instructions that are sent between the sound source LSI 204 and the CPU 201. The CPU I/F 215 controls these processes such that the CPU 201 sees the DSP 206 simply as a memory element and the DSP 206 likewise sees the CPU 201 simply as a memory element. This scheme makes it possible for data written to memory by one of these components to be read by the other component.

The oscillator 209 supplies the system clock (a reference clock) to the CPU 201. The oscillator 210 supplies a reference clock for generating the sampling clock to the waveform generator 205 and the DSP 206 of the sound source LSI 204. The waveform generator 205 and the DSP 206 of the sound source LSI 204 operate in complete synchronization due to being supplied with the same reference clock for generating the sampling clock from the dedicated oscillator 210 of the sound source LSI 204. Meanwhile, the CPU 201 operates using the system clock supplied by the dedicated oscillator 209. Therefore, in general the operation of the CPU 201 is not synchronized with the operation of the waveform generator 205 and the DSP 206. In the present embodiment, however, a process synchronization feature (described later) synchronizes the tempo of an automatic performance control process executed by the CPU 201 with the delay time of a delay process executed by the DSP 206.

In the present embodiment, the oscillator 210 functions as a first clock generator, and the oscillator 209 functions as a second clock generator.

The key scanner 211 is an integrated circuit (IC) that scans the state of the keyboard 101 and components of the switch panel such as the feature selection controls 102 and the tone selection buttons 103 and then notifies the CPU 201 of these states. The A/D converter 212 is an IC that detects analog signals indicating the operation position of the bender/modulation wheels 104 as digital signals. The LCD controller 213 is an IC that controls the LCD 105.

Figure 3:
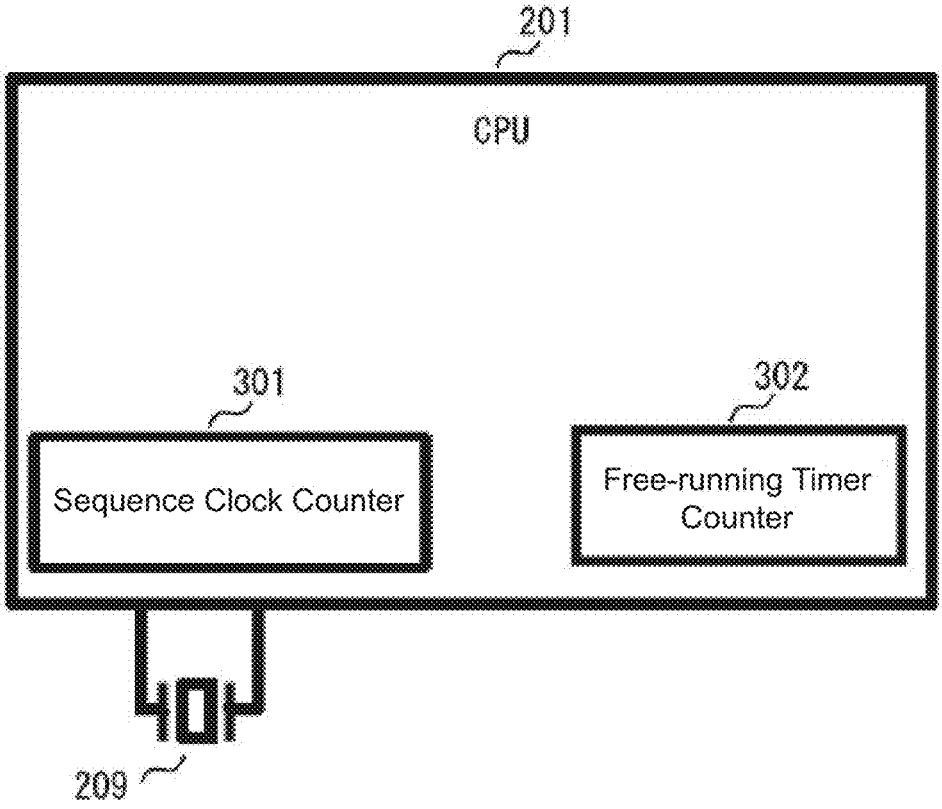
FIG. 3 illustrates an example configuration of a counter circuit built into a CPU 201.

FIG. 3 illustrates an example configuration of a counter circuit built into the CPU 201 illustrated in FIG. 2. The CPU 201 includes a sequence clock counter 301 that divides up and counts the system clock generated by the oscillator 209 and a free-running timer counter 302 that functions as a clock for referencing an instant or time. These timer counters both increment the counts in 1 μsec (microsecond) units. The sequence clock counter 301 cyclically counts the system clock generated by the oscillator 209 from zero to a maximum sequence clock count that corresponds to a time equal to 1/480 of one beat of a specified tempo. The sequence clock counter 301 issues a sequence clock interrupt to the CPU 201 each time the system clock count reaches the maximum sequence clock count. Once the count reaches the maximum sequence clock count, the sequence clock counter 301 resets the count to 0 and then continues to cyclically repeat this counting behavior.

In the present embodiment, the sequence clock counter 301 corresponds to a second counter, and the maximum sequence clock count corresponds to a second count value.

The CPU 201 also executes the automatic performance control process, which advances an automatic performance in synchronization with the sequence clock interrupts generated by the sequence clock counter 301. In other words, the automatic performance control process uses the sequence clock interrupts (which correspond to 1/480 of one beat of the specified tempo) as a reference while running. 480 sequence clock interrupt trigger signals are generated during each beat of the tempo, and the automatic performance advances in synchronization with those interrupts. In other words, the tempo of the performance depends on the frequency at which these sequence clock interrupts are generated. The tempo of the automatic performance can be increased and decreased using a DOWN button 102*a* and an UP button 102*b* in the TEMPO area of the feature selection controls 102 illustrated in FIG. 1. In the present embodiment, the DOWN button 102*a* and the UP button 102*b* form a tempo specification unit. The tempo can be set from a minimum of 30 beats per minute (BPM) to a maximum of 300 BPM in 1 BPM increments. The time interval at which the sequence clock interrupts are generated is determined by synchronizing with this tempo.

The free-running timer counter 302 is a clock that has a 32-bit data width and repeatedly counts from 0 to a maximum value (the count is reset to 0 upon reaching the maximum value). This count gives the instant or time at the point in time that the clock is referenced. As will be described later, the CPU 201 references the free-running timer counter 302 each time the sequence clock interrupts occur a number of times corresponding to a delay time set in the delay process executed by the DSP 206 of the sound source LSI 204 in order to get the instant or time at which each interrupt occurs and synchronize with the delay process in the DSP 206.

Next, the flow of operations on audio signals in the sound source LSI 204 will be described. As illustrated in FIG. 2, audio signals output from the waveform generator 205 are sent to the DSP 206. The DSP 206 then applies a delay effect to the audio signals. Of the audio signals output from the waveform generator 205, the delay effect is applied to the audio signals generated by the waveform generator 205 in accordance with user (performer) operations on the keyboard 101. Meanwhile, the delay effect may also be applied to the audio signals generated by the waveform generator 205 in accordance with the automatic performance control process executed by the CPU 201, or these signals may be left as-is without the delay effect applied thereto, mixed together at the output stage of the DSP 206 with the audio signals to which the delay effect was applied, and then output. The audio signals transferred within the sound source LSI 204 and the audio signals output from the DSP 206 are both sampled and processed according to the same sampling clock and at a sampling frequency of 44.1 kHz, for example. This sampling clock is generated by dividing, within the sound source LSI 204, the reference clock generated by the oscillator 210 that is connected to the sound source LSI 204. As a result, the sampling frequency is perfectly proportional to the oscillation frequency of the oscillator 210. Moreover, if fluctuations occur in the oscillation frequency of the oscillator 210, the sampling frequency is affected by exactly the same amount.

The waveform generator 205 of the sound source LSI 204 has a feature for generating musical note waveforms using a standard waveform loading scheme. More specifically, the waveform generator 205 generates audio signals by loading musical note waveform data of a type specified in advance by the CPU 201 from the sound source ROM 207 (which functions as the waveform memory) while interpolating at a read speed that corresponds to the pitches specified by note-on instructions that are sequentially issued from the CPU 201.

Figure 4A:
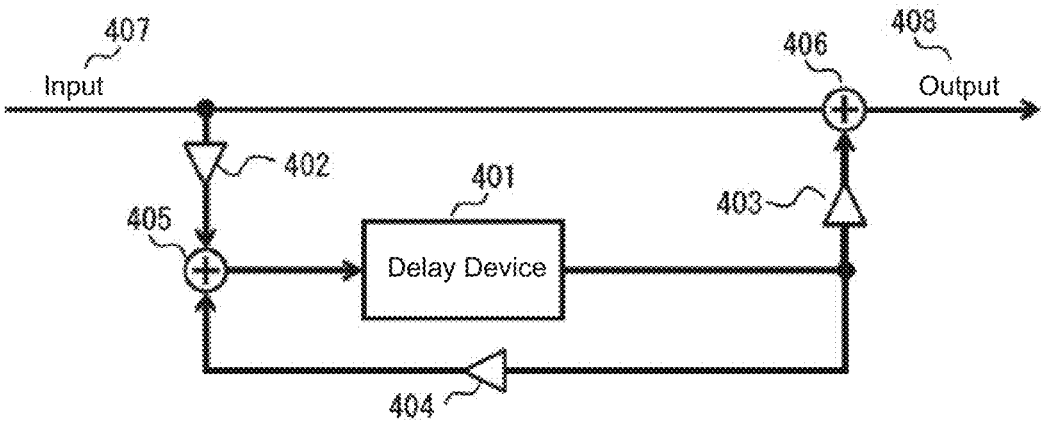
FIGS. 4A to 4C illustrate a delay process executed by a DSP 206.

FIG. 4A is a functional block diagram of the delay process executed by the DSP 206 of the sound source LSI 204. First, audio signals 407 input from the waveform generator 205 are divided up such that some of the audio signals 407 are sent directly to an adder 406 on the output side and the rest of the audio signals 407 are sent via an amplifier 402 and an adder 405 to a delay device 401, where the delay process is executed. The output of the delay device 401 is sent via an amplifier 403 to the adder 406, where that output is mixed together with the audio signals 407 that were sent directly (which are fundamental tones). The level of the delayed tones relative to the fundamental tones can be adjusted using the delay input volume adjustment amplifier 402 and the delay output volume adjustment amplifier 403. The output of the delay device 401 can also be fed back through the adder 405 to the input side of the delay device 401, the amount of the output that is fed back being set by a feedback amount adjustment amplifier 404. The closer the amplification factor of the amplifier 404 is set to 1.0, the more times the audio signal will be repeated.

A special mode known as delay hold mode is also prepared for the delay process. The user enables delay hold mode by pressing the HOLD button in the feature selection controls 102 illustrated in FIG. 1, which illuminates a HOLD button LED. In this state, the gain of the feedback amount adjustment amplifier 404 is set to 1.0, thereby making it possible to continually repeat and output the delayed audio signals output from the delay device 401 without any attenuation until the user presses the HOLD button again, which turns off the HOLD button LED and disables delay hold mode. At the instant this mode is enabled, the amplification factor of the delay input volume adjustment amplifier 402 (which is normally set to 1.0) is set to 0 such that the delay effect is not applied to any subsequently input audio signals 407. As a result, the audio signals generated as the delay device 401 repeatedly delays the audio signals input to the delay device 401 immediately before delay hold mode was enabled are mixed together with the newly input audio signals 407 by the adder 406, which then outputs these mixed audio signals. This functionality is known as a so-called sample looper feature.

Figure 4B:
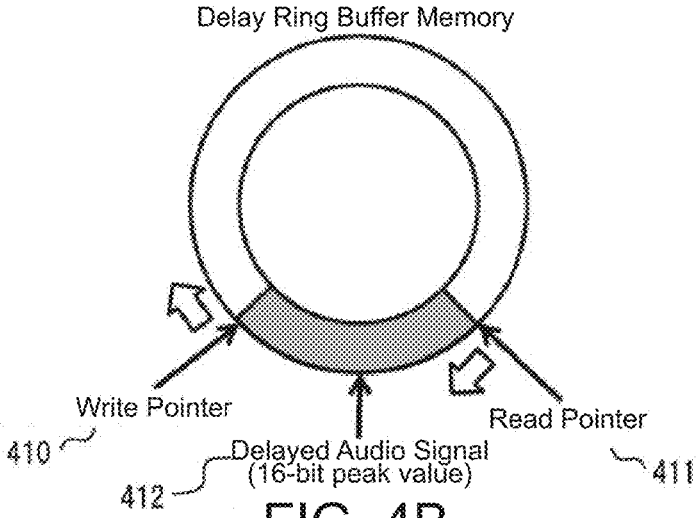
Figure 4C:
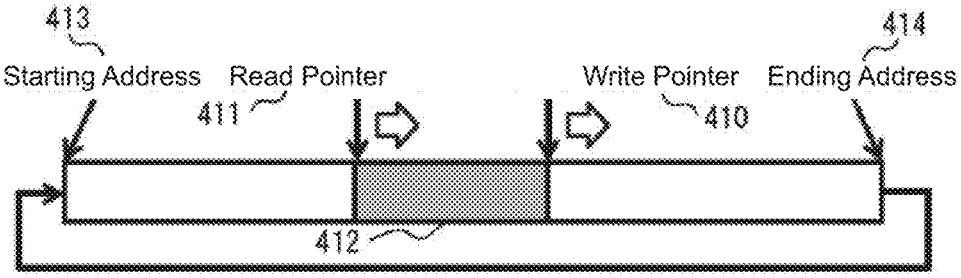

FIG. 4B is an explanatory drawing of the delay device 401 illustrated in FIG. 4A. The delay device 401 is implemented as a feature in which the DSP 206 accesses the DSP RAM 208. The DSP RAM 208 functions as a delay ring buffer memory which is conceptually managed using a so-called ring buffer scheme, in which the values of a write pointer 410 and a read pointer 411 that specify addresses are looped at the next address after an ending address 414 such that in a buffer area, a memory region corresponding to the ending address 414 is virtually connected to a memory region corresponding to a starting address 413. In this delay ring buffer memory, the write address specified by the value of the write pointer 410 and the read address specified by the value of the read pointer 411 are set to a prescribed interval, and these pointer values are incremented by one address in each cycle of the sampling clock. In this way, the values of the audio signals input from the adder 405 are written and the values of the audio signals sent to the output side are read. Moreover, as illustrated in FIG. 4C, in the delay ring buffer memory, when the write pointer 410 and the read pointer 411 specify the ending address 414, the next address to be specified is the starting address 413. This address moving behavior is repeated indefinitely as long as the device remains operating.

Therefore, as illustrated in FIGS. 4B and 4C, from the time the write process is performed until the time the read process is performed, the 16-bit peak values of the audio signals that are temporary stored at each address in the delay ring buffer memory become audio signals 412 that are currently being delayed. Moreover, the relative difference between the addresses specified by the write pointer 410 and the read pointer 411 is the delay time, which represents the amount of delay. A delay of the magnitude given below by expression (1) occurs for each one address in this difference.

$$(1 \div 44.1\ \text{kHz})\ \text{sec} \approx 22.7\ \mu\text{sec} \tag{1}$$

The present embodiment includes a delay ring buffer memory of 300,000×2 bytes (300,000 words) in size, for example, and each sample is 1 word (2 bytes=16 bits) in size. Therefore, a maximum delay time of 22.7 μsec× 300000≈6.8 sec can be achieved. To achieve a delay time of 1 second, for example, the write pointer 410 should be set to a value that is 44.1 KHz×1000×1 sec=44100 addresses less than the value of the read pointer 411. In the example illustrated in FIGS. 4B and 4C, the audio signals 412 that are currently being delayed occupy approximately 1/4 of the delay ring buffer memory, and thus the currently configured delay time is 6.8 seconds÷4≈1.7 sec. Therefore, the difference between the write pointer 410 and the read pointer 411 is 44100×1.7 sec=74970 addresses.

The delay effect that includes the abovementioned delay time can be specified by using the group of controls in the DELAY area of the feature selection controls 102 illustrated in FIG. 1 as described below.

- SYNC button (includes LED indicator): This control enables/disables delay tempo synchronization mode, which synchronizes the delay time to the tempo. When the user enables this mode, the BEAT knob (described below) can be used to configure a setting that synchronizes the delay time to the tempo. Moreover, when this mode is disabled, the delay time value can be set freely using the TIME knob (described below).
- HOLD button (includes LED indicator): This control enables/disables the delay hold mode described above.
- BEAT knob: When delay tempo synchronization mode is enabled, this control specifies how many beats of the tempo the delay time is synchronized to. The user can select from eight settings according to the position of this knob: setting 0 (1/4 beat), setting 1 (1/3 beat), setting 2 (1/2 beat), setting 3 (2/3 beat), setting 4 (1 beat), setting 5 (3/2 beat), setting 6 (2 beats), and setting 7 (3 beats). When delay tempo synchronization mode is disabled, BEAT knob operations are ignored.
- TIME knob: When delay tempo synchronization mode is disabled, this control directly specifies the delay time. The delay time can be adjusted from 0 to 12316 (2 sec), for example. When delay tempo synchronization mode is enabled, TIME knob operations are ignored.
- REPEAT knob: When delay hold mode is disabled, this control adjusts the delay feedback amount. The value specified here determines the gain of the feedback amount adjustment amplifier 404 illustrated in FIG.

4A. When delay hold mode is enabled, the feedback amount is force-set to 100%.

LEVEL knob: This control adjusts the level of the delay signal. The value specified here determines the gain of the delay output volume adjustment amplifier 403 illustrated in FIG. 4A.

The four BEAT, TIME, REPEAT, and LEVEL knobs described above make it possible to set the values of the respective parameters from a minimum value to a maximum value according to the position (rotation angle) of the knob. For example, setting a knob to the center position sets a value halfway between the respective minimum value and the maximum value.

Next, a control process for synchronizing the automatic performance control process executed by the CPU 201 to the delay process executed by the DSP 206 of the sound source LSI 204 in the present embodiment will be described. As described above, the timing of the automatic performance control process executed by the CPU 201 is controlled according to the sequence clock interrupts generated each time the sequence clock counter 301 in the CPU 201 cyclically counts the system clock from the oscillator 209 to a maximum sequence clock count that corresponds a time equal to 1/480 of one beat of a specified tempo (BPM). Here, when delay tempo synchronization mode (that is, the mode in which the delay time is synchronized to the specified tempo) is enabled, the CPU 201 sequentially monitors the difference between the delay time set by the delay device 401 (see FIG. 4A) of the DSP 206 and synchronized to the sampling clock and a time corresponding to a delay time that is synchronized with the sequence clock interrupts. The CPU 201 then adjusts the timing at which the sequence clock interrupts occur in order to correct that difference. It is also theoretically possible to use the sampling clock generated by the sound source LSI 204 as-is as the reference clock for the automatic performance control process. However, in consideration of the fact that using a sampling rate of 44.1 kHz (that is, units of 22.7 μsec) to apply changes to the sequence clock interrupts (which are equal to 1/480 of one beat) is too imprecise and the fact that it takes several dozen beats of the performance for the difference relative to the system clock generated by the CPU 201 (which is incremented in units of 1 μsec) to increase to a perceptible level, it is more practical for the delay process and the automatic performance control process to be executed using separate clocks and then be corrected as appropriate. Therefore, in the present embodiment, once a delay time that is set to be a natural number multiple or a natural number fraction of the specified tempo in delay tempo synchronization mode is configured, the CPU 201 compares a time measured by the DSP 206 in units of the sampling clock to a time measured by the CPU 201 in units of the number of sequence clock interrupts. Then, if the time measured by the CPU 201 is lagging behind, the maximum sequence clock count at which the count of the sequence clock counter 301 reaches the upper limit is decreased and the timing of the sequence clock interrupts is sped up slightly. Conversely, if the time measured by the CPU 201 is farther ahead, the maximum sequence clock count is increased and the timing of the sequence clock interrupts is slowed down. In this way, the CPU 201 automatically implements an adjustment process that gradually brings the two times together.

Proper musical coordination is not achieved unless not only does the delay time match the period of the music but the music also matches the phases of the individual musical notes emitted when the delay effect is applied. However, the adjustment process of the present embodiment makes it possible to not only match the delay period but to also match the phases.

FIG. 5A illustrates an example of the data configuration of a tempo-count table (hereinafter, "TEMPO_COUNT_TBL") stored in the CPU ROM 202. FIG. 5B illustrates an example of the data configuration of a supplementary data table for explaining the TEMPO_COUNT_TBL. Note that the supplementary data table is only illustrated for convenience in order to explain the TEMPO_COUNT_TBL and is not actually implemented in the present embodiment. The example of the TEMPO_COUNT_TBL illustrated in FIG. 5A includes the following data items: TEMPO, DELAY_COUNT, and SEQ_CLOCK_COUNT. The rows of the TEMPO_COUNT_TBL give the DELAY_COUNT values and the SEQ_CLOCK_COUNT values set for each TEMPO value, where the tempo can be specified in 1 beat per minute (BPM) increments from 30 to 300 BPM. Note that in the following description, the TEMPO, DELAY_COUNT, and SEQ_CLOCK_COUNT values themselves may be referred to simply as TEMPO, DELAY_COUNT, and SEQ_CLOCK_COUNT.

DELAY_COUNT represents the sampling clock count corresponding to when the delay time set to the delay device 401 (see FIG. 4A) of the DSP 206 (FIG. 2) is synchronized to one beat of the specified tempo (TEMPO) and that delay time is counted using the sampling clock generated according to the oscillator 210 illustrated in FIG. 2 that is connected to the sound source LSI 204. For example, when the frequency of the sampling clock is set to 44.1 kHz, the DELAY_COUNT value set for each TEMPO entry of the TEMPO_COUNT_TBL is given by equation (2) below.

$$\text{DELAY_COUNT}=(60/\text{TEMPO})/\{(1/(44.1\times1000)\} \quad (2)$$

SEQ_CLOCK_COUNT represents the system clock count required for the sequence clock counter 301 (which is implemented in the CPU 201 and counts up the system clock from the oscillator 209 that is connected to the CPU 201; see FIG. 3) to issue a sequence clock interrupt, which corresponds to 1/480 of one beat of the specified tempo (TEMPO). Assuming one cycle of the system clock to be equal to 1 μsec, for example, SEQ_CLOCK_COUNT corresponds to the time (in μsec) required to count one cycle of the sequence clock using the system clock of the CPU 201. The SEQ_CLOCK_COUNT value (in μsec) set for each TEMPO entry of the TEMPO_COUNT_TBL is given by equation (3) below.

$$\text{SEQ_CLOCK_COUNT}=\{(60/\text{TEMPO})/480\}\times1{,}000{,}000 \quad (3)$$

Next, supplementary data 1 in FIG. 5B represents the time required to sample the number of sampling clock cycles represented by DELAY_COUNT; that is, the delay time (in msec) as counted using the sampling clock of the DSP 206. This supplementary data 1 can be calculated using the DELAY_COUNT value of the TEMPO_COUNT_TBL illustrated in FIG. 5A, as given below by equation (4).

$$\text{Supplementary data 1}=\{1/(44.1\times1000)\times\text{DELAY_COUNT}\times1000 \quad (4)$$

Next, supplementary data 2 in FIG. 5B represents the time difference (in msec) between the DELAY_COUNT sampling time given by supplementary data 1 and the time required to count one beat worth of sequence clock interrupts in the CPU 201. In other words, supplementary data 2 is the time difference between the required time based on the sampling clock of the DSP 206 and the required time based on the sequence clock interrupts in the CPU 201 when the delay time is synchronized to one beat of the specified tempo value TEMPO. This supplementary data 2 can be calculated using the supplementary data 1 (msec) and the SEQ_CLOCK_COUNT value (μSec) of the TEMPO_COUNT_TBL illustrated in FIG. 5A, as given below by equation (5).

$$\text{Supplementary data 2}=\text{Supplementary data 1}-(\text{SEQ_CLOCK_COUNT}/1000)\times 480 \quad (5)$$

Furthermore, supplementary data 3 in FIG. 5B represents the total accumulated value of the abovementioned time difference (which is calculated for a case in which the delay time is synchronized to one beat of the specified tempo value TEMPO) when 32 bars of an automatic performance song are played in a 4/4 time signature. This supplementary data 3 can be calculated using the supplementary data 2, as given below by equation (6).

$$\text{Supplementary data 3}=\text{Supplementary data 2}\times 4\times 32 \quad (6)$$

As shown by supplementary data 2 in FIG. 5B, each one delay of the delay time that is synchronized to one beat of the specified tempo value TEMPO does not cause a large time difference between the control process based on the sampling clock in the DSP 206 and the control process based on the sequence clock interrupts in the CPU 201. However, when delay hold mode is enabled and the abovementioned sample looper is implemented, for example, the delayed audio signals are repeatedly used across several bars. In this case, as shown by supplementary data 3, a time difference large enough to be audible to the human ear is created. Note also that these are theoretical values that do not take the precision of the oscillators into account. In reality, it is also necessary to consider an additional difference of approximately (±0.1% to ±0.001%) due to errors arising from the precision of the oscillators.

Given the relationships in equations (5) and (6) above, when supplementary data 2 and 3 in FIG. 5B have positive values, this indicates that the SEQ_CLOCK_COUNT count of the delay time as based on the sequence clock of the CPU 201 is larger than the DELAY_COUNT count of the delay time as based on the sampling clock of the DSP 206. In this case, decreasing the SEQ_CLOCK_COUNT value by this positive amount makes it possible to make the time difference between the control process based on the sampling clock of the DSP 206 and the control process based on the sequence clock interrupts in the CPU 201 approach 0 during the next delay process.

Meanwhile, when supplementary data 2 and 3 have negative values, this indicates that the SEQ_CLOCK_COUNT count of the delay time as based on the sequence clock of the CPU 201 is less than the DELAY_COUNT count of the delay time as based on the sampling clock of the DSP 206. In this case, increasing the SEQ_CLOCK_COUNT value by this negative amount makes it possible to make the time difference between the control process based on the sampling clock of the DSP 206 and the control process based on the sequence clock interrupts in the CPU 201 approach 0 during the next delay process.

Figure 6:
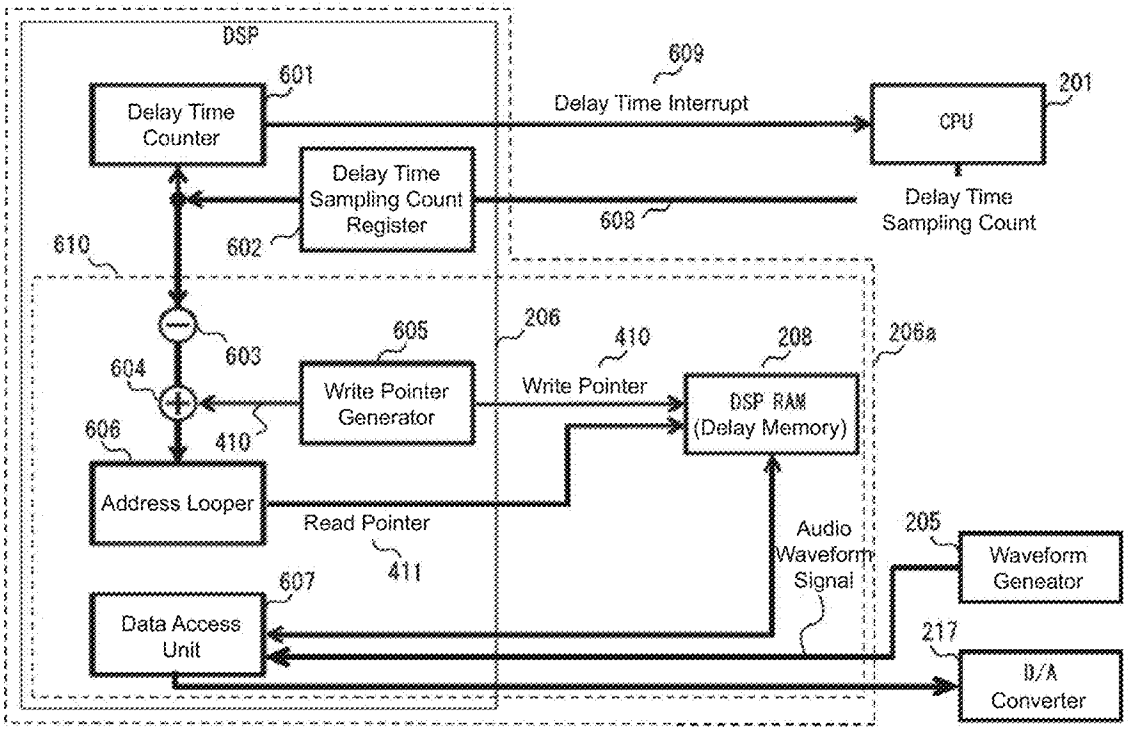
FIG. 6 is a block diagram illustrating an example of a mechanism that executes a delay time interrupt generation process and a mechanism that generates address pointers, which are included in the DSP 206.

To implement the control process described above, the present embodiment includes, in the DSP 206, a mechanism for issuing delay time interrupts to the CPU 201 and a mechanism for generating address pointers for accessing the DSP RAM 208 that is connected to the DSP 206. FIG. 6 is a block diagram illustrating an example of a mechanism that executes a delay time interrupt generation process and a mechanism that generates address pointers for the delay process, which are included in the DSP 206. As illustrated in FIG. 6, the DSP 206 includes a delay time counter 601, a delay time sampling count register 602, a sign inverter 603, an adder 604, a write pointer generator 605, an address looper 606, and a data access unit 607.

In the present embodiment, the delay time counter 601 functions as a first counter.

Furthermore, together the sign inverter 603, the adder 604, the write pointer generator 605, the address looper 606, and the data access unit 607 of the DSP 206 as well as the DSP RAM 208 that is connected to the DSP 206 form an audio effect circuit 610.

When the user presses the SYNC button in the DELAY area of the feature selection controls 102 illustrated in FIG. 1 and thereby illuminates the SYNC button LED indicator, the delay tempo synchronization mode in which the delay time is synchronized to the tempo is enabled. In this mode, the CPU 201 first gets the DELAY_COUNT value from the entry of the TEMPO_COUNT_TBL illustrated in FIG. 5A and stored in the CPU ROM 202 in which the user-specified tempo value is set to TEMPO (that is, the sampling clock count for when the delay time is synchronized to one beat of the specified tempo value (TEMPO)). However, this DELAY_COUNT value is a reference value corresponding to the when the delay time is synchronized to one beat of the specified tempo. Therefore, in reality the CPU 201 multiplies the retrieved DELAY_COUNT value by 1/4, 1/3, 1/2, 2/3, 1, 3/2, 2, or 3 (the synchronization beat count division ratio as set using the BEAT knob in the DELAY area of the feature selection controls 102) in order to calculate a delay time sampling count 608 corresponding to the delay time for the specified synchronization beat count of the specified tempo. For example, if 1/2 is specified as the synchronization beat count, the CPU 201 multiplies DELAY_COUNT by 1/2.

The CPU 201 sets the delay time sampling count 608 calculated as described above to the delay time sampling count register 602 of the DSP 206 via the system bus 216, the CPU I/F 215, and the sound source LSI 204.

The delay time sampling count 608 set to the delay time sampling count register 602 is then set as the maximum count of the delay time counter 601. The delay time counter 601 cyclically counts the sampling clock from zero to the delay time sampling count 608 and issues a delay time interrupt 609 to the CPU 201 each time the sampling clock count reaches this maximum value in order to notify the CPU 201 that one period of the delay time as set to the synchronization beat count value has elapsed. The delay time counter 601 then resets the count to 0 and repeats this counting behavior.

In the present embodiment, the maximum count of the delay time counter 601 corresponds to a first count value.

The write pointer generator 605 generates the write pointer 410 described with reference to FIGS. 4B and 4C. The write pointer generator 605 generates address values that are incremented by 1 according to the sampling clock from the starting address 413 to the ending address 414 illustrated in FIGS. 4A to 4C. When this address value reaches the ending address 414, the write pointer generator 605 resets the next generated address to the starting address 413 and then continues to repeat the behavior described above. The address value of the write pointer 410 thus generated is then sent as a write address to the DSP RAM 208 (see FIG. 2) that is connected to the DSP 206.

The delay time sampling count 608 set to the delay time sampling count register 602 is also converted to a negative value by the sign inverter 603 and then input to the adder 604. The adder 604 generates the read pointer 411 described with reference to FIGS. 4B and 4C by adding the negative value of the delay time sampling count 608 to the value of the write pointer 410 generated by the write pointer generator 605 (that is, by subtracting the value of the delay time sampling count 608 from the value of the write pointer 410). When the value of the read pointer 411 is less than the starting address 413 illustrated in FIG. 4C, the address looper 606 adds a value of (ending address 414−starting address 413+1) to the value of the read pointer 411 in order to loop the address back to the side closer to the ending address 414. The address value of the read pointer 411 that is ultimately thus generated is then sent as a read address to the DSP RAM 208 that is connected to the DSP 206.

In each sampling clock cycle, the data access unit 607 writes, to the write address sent from the write pointer generator 605 to the DSP RAM 208, at least one of an audio waveform signal sent from the waveform generator 205 and an audio waveform signal read from the DSP RAM 208 and also reads an audio waveform signal from the read address sent from the address looper 606 to the DSP RAM 208 and then outputs that audio waveform signal to the D/A converter 217 (see FIG. 2 and FIGS. 4B and 4C). In this way, the functionality of the of the delay device 401 illustrated in FIG. 4A is implemented. The DSP 206 thus executes the process illustrated in the block diagram in FIG. 4A (which includes the behavior of the delay device 401) on the audio signals input from the waveform generator 205 (see FIG. 2) and then outputs the audio signals from the adder 406 to the D/A converter 217 as output 408.

In addition to the configuration of the DSP 206 as described above, the present embodiment also includes a mechanism for executing a sequence clock correction process in the CPU 201. When delay tempo synchronization mode is enabled, the CPU 201 first gets the SEQ_CLOCK_COUNT value from the entry of the TEMPO_COUNT_TBL illustrated in FIG. 5A and stored in the CPU ROM 202 in which the user-specified tempo value is set to TEMPO (that is, the system clock count (in μsec) required for a sequence clock interrupt (which is equal to 1/480 of one beat of the specified tempo (TEMPO)) to occur). The CPU 201 then sets this SEQ_CLOCK_COUNT value to the sequence clock counter 301 (see FIG. 3) of the CPU 201 as the maximum sequence clock count. As described above, the sequence clock counter 301 cyclically counts the system clock generated by the oscillator 209 from zero to the maximum sequence clock count. The sequence clock counter 301 issues a sequence clock interrupt to the CPU 201 each time the system clock count reaches the maximum sequence clock count in order to notify the CPU 201 that one period of the sequence clock that is equal to 1/480 of one beat of the specified tempo has elapsed. The sequence clock counter 301 then resets the count to 0 and repeats this counting behavior.

Once the CPU 201 receives, from the sequence clock counter 301, the number of sequence clock interrupts corresponding to the synchronization beat count corresponding to the setting configured using the BEAT knob in the DELAY area of the feature selection controls 102, the CPU 201 reads the current instant or time from the count of the free-running timer counter 302 (FIG. 3) and then stores this instant or time. The CPU 201 reads this number of sequence clock interrupts from a synchronization beat count table stored in the CPU ROM 202. FIG. 7A illustrates an example of the data configuration of this synchronization beat count table (hereinafter, "SYNC_BEAT_TBL"). FIG. 7B illustrates an example of the data configuration of a supplementary data table for explaining the SYNC_BEAT_TBL. Like the supplementary data table in FIG. 5B, the supplementary data table in FIG. 7B is only illustrated for convenience in order to explain the SYNC_BEAT_TBL and is not actually implemented in the present embodiment. When the user uses the BEAT knob to set one of the eight synchronization beat count settings (0, 1, 2, 3, 4, 5, 6, or 7), the CPU 201 accesses the entry of the SYNC_BEAT_TBL corresponding to that setting and gets a NUMERATOR value and a DENOMINATOR value. Note that in the following description, the NUMERATOR and DENOMINATOR values themselves may be referred to simply as NUMERATOR and DENOMINATOR. The CPU 201 then determines the synchronization beat count on the basis of these values as NUMERATOR/DENOMINATOR. The supplementary data table in FIG. 7B shows the synchronization beat counts for each setting. In this way, the synchronization beat counts for settings 0, 1, 2, 3, 4, 5, 6, and 7 are calculated to be 1/4, 1/3, 1/2, 2/3, 1, 3/2, 2, and 3, respectively. The supplementary data table in FIG. 7B also shows the number of sequence clock interrupts that should be counted (hereinafter, the "synchronization sequence clock count") for each synchronization beat count. For setting 4, for example, NUMERATOR=1 and DENOMINATOR=1, and therefore the synchronization beat count is 1/1=1. Moreover, because each sequence clock interrupt is equal to 1/480 of one beat, when the synchronization beat count is 1, the synchronization sequence clock count is 480. Furthermore, for setting 0, NUMERATOR=1 and DENOMINATOR=4, and therefore the synchronization beat count is 1/4 and the synchronization sequence clock count is 480×1/4=120. More specifically, the CPU 201 gets the NUMERATOR value and the DENOMINATOR value of the entry corresponding to the setting specified using the BEAT knob, calculates the synchronization beat count b using equation (7) below, and then determines the synchronization sequence clock count s (that is, the number of sequence clock interrupts at which the current instant or time should be read from the free-running timer counter 302) using equation (8) below.

$$b=\text{NUMERATOR}/\text{DENOMINATOR} \tag{7}$$

$$s=480\times b \tag{8}$$

Meanwhile, when the CPU 201 receives the delay time interrupt 609 from the delay time counter 601 of the DSP 206, the CPU 201 reads the current instant or time from the count of the free-running timer counter 302 (FIG. 3) and then stores this instant or time. As described above, the delay time interrupt 609 is sent from the DSP 206 to the CPU 201 each time one period of the delay time as set to the synchronization beat count in the delay process in the DSP 206 is counted using the sampling clock.

Once the CPU 201 has the instant or time at which the number of sequence clock interrupts corresponding to the synchronization beat count (=s interrupts) are received in the CPU 201 (hereinafter, this instant or time in the CPU 201 will be referred to as the "LAST_BEAT_TIME") and the instant or time at which the delay time interrupt 609 (which occurs when one period of the delay time corresponding to the synchronization beat count is counted using the sampling clock) is received from the DSP 206 (hereinafter, this instant or time in the DSP 206 will be referred to as the "LAST_DELAY_TIME"), the CPU 201 calculates the time difference d between those two instants or times using equation (9) below.

$$d=\text{LAST_BEAT_TIME}-\text{LAST_DELAY_TIME} \tag{9}$$

In order to reduce this time difference, the CPU 201 increases or decreases the maximum sequence clock count that is set to the sequence clock counter 301 illustrated in FIG. 3. More specifically, when this time difference is a positive value (that is, when LAST_BEAT_TIME is an instant or time after LAST_DELAY_TIME), it is taking too long for the sequence clock counter 301 in the CPU 201 to reach the maximum count and issue a sequence clock interrupt, and therefore the CPU 201 decreases the maximum sequence clock count by subtracting a value obtained by converting the positive time difference value to one synchronization beat count's worth of time (=one delay time period) from the maximum sequence clock count. Meanwhile, when this time difference is a negative value (that is, when LAST_BEAT_TIME is an instant or time before LAST_DELAY_TIME), the sequence clock counter 301 in the CPU 201 is reaching the maximum count and issuing a sequence clock interrupt too quickly, and therefore the CPU 201 increases the maximum sequence clock count by subtracting a value obtained by converting the negative time difference value to one synchronization beat count's worth of time (=one delay time period) from the maximum sequence clock count. In other words, the CPU 201 uses the synchronization beat count b calculated using equation (7) and the time difference d calculated using equation (9) to calculate a correction c for the maximum sequence clock count, as given below by equation (10).

$$c=d/(480\times b) \tag{10}$$

The CPU 201 then subtracts the correction c thus calculated from the maximum sequence clock count and sets the new maximum sequence clock count to the sequence clock counter 301. Therefore, in the next delay process, the shift between the timing of the automatic performance (which is advanced by an amount equal to the delay time in terms of the sequence clock interrupts in the CPU 201) and the timing of the delay process (which has a length equal to the delay time in the DSP 206) will be removed. The sequence of control processes in the present embodiment as described above will be referred to as a "delay synchronization process" (a process synchronization unit).

Figures 8A, 8B, 8C, 8D, 8E, 8F, 8G:
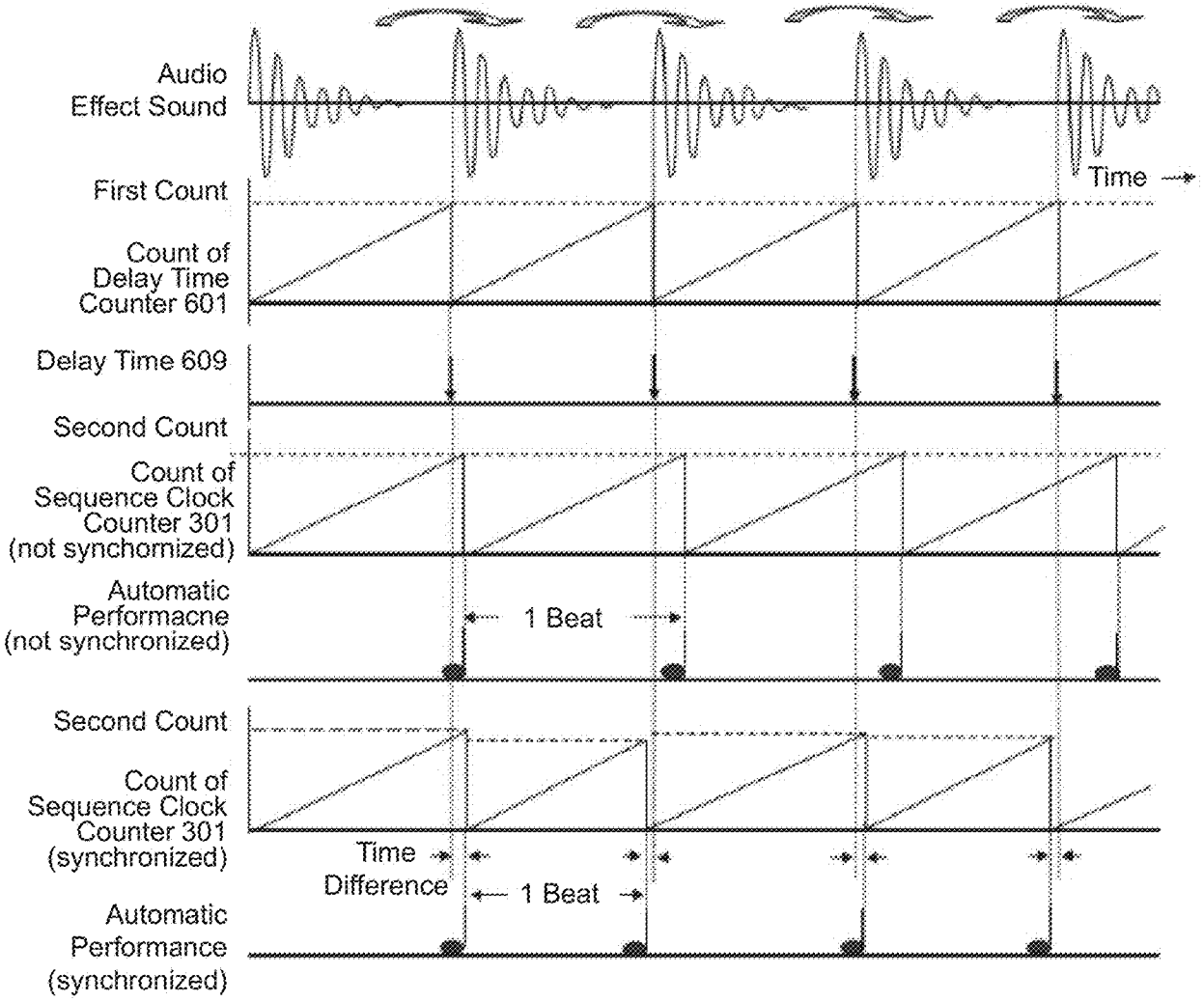
FIGS. 8A to 8G are explanatory drawings of the behavior of the embodiment.

Furthermore, the correction c calculated using equation (10) is an integer value. Therefore, if a process for truncating any decimal portion is implemented, the correction c is 0 as long as the time difference d is within the synchronization sequence clock count, and no correction is performed. However, the problem to be solved by the present embodiment is when the shift accumulates to approximately 10 msec or 20 msec and becomes perceptible. Correcting small shifts on the order of several hundred μsec has almost no effect and is not an issue here. For example, when the synchronization beat count is 1/2, the synchronization sequence clock count is 240. However, increasing this synchronization sequence clock count (which is the maximum count of the sequence clock counter 301) by 1 cycle would only increase the interval at which the sequence clock interrupts occur by 1 μsec, which would only result in a correction of 240×1 μsec=240 μsec by the next time the delay was synchronized. Although no correction is performed for shifts of less than 240 μsec, this is not an issue because shifts of this magnitude are not musically perceptible. FIGS. 8A to 8G are explanatory drawings of the behavior of the present embodiment. FIG. 8A illustrates how when the DSP 206 executes a sample looper delay process in which a prescribed synchronization beat count of one beat relative to the specified tempo is set as the delay time in order to implement an audio effect process, the same audio signal waveform is repeatedly played as an audio effect sound. FIG. 8B illustrates how the delay time counter 601 repeatedly counts from 0 to the first count value (that is, the maximum count, which is the delay time sampling count 608 as set according to one beat). As illustrated in FIG. 8C, each time the count of the delay time counter 601 reaches the maximum count and the audio signal waveform is played again, the interrupt signal 609 is generated.

In response, the CPU 201 executes the automatic performance control process according to the sequence clock, which is generated relative to the specified tempo. More specifically, in order to determine the timing of the beats of the automatic performance, the sequence clock counter 301 repeatedly counts the sequence clock from 0 to the maximum sequence clock count as set according to one beat. However, the sequence clock and the sampling clock have different cycles and are not synchronized. Therefore, as illustrated in FIG. 8D, when the delay synchronization process of the present embodiment is not executed, as the audio signal waveform is repeatedly played, the timing at which the corresponding 480th count of the sequence clock counter 301 reaches the second count value (that is, the maximum count) gradually shifts away from the timing at which the audio signal waveform is repeated (the timing indicated by the dotted lines in FIGS. 8A to 8G).

As a result, as illustrated in FIG. 8E), if the automatic performance is advanced using this timing as the timing of the beats of the automatic performance, the shift between the timing of the beats of the automatic performance and the timing at which the audio signal waveform is repeated increases.

Meanwhile, when the delay synchronization process of the present embodiment is executed, as illustrated in FIG. 8F, the time difference between the timing at which the interrupt signals 609 occur and the timing at which the sequence clock counter 301 reaches the maximum count is calculated, and the maximum count of the sequence clock counter 301 is then increased or decreased accordingly in order to decrease this time difference.

As illustrated in FIG. 8G, this makes it possible to always keep the timing of the beats of the automatic performance (that is, the timing at which the sequence clock counter 301 reaches the maximum count) synchronized to the timing at which the audio signal waveform is repeated. In this way, the present embodiment makes it possible to avoid large shifts relative to the delay process in the DSP 206 while putting only a light load on the CPU 201.

Next, an electronic musical instrument control process that includes the delay synchronization process (which the CPU 201 illustrated in FIG. 2 executes according to a delay synchronization program stored in the CPU ROM 202 in order to achieve the basic behavior described above) will be described in detail.

FIG. 9A illustrates an example of the data configurations (constant values) of the TEMPO_COUNT_TBL (tempo-count table) illustrated in FIG. 5A and the SYNC_BEAT_TBL (synchronization beat count table) illustrated in FIG. 7A, which are stored in the CPU ROM 202. FIG. 9B illustrates a list of the main variables that are stored in the CPU RAM 203 and are used by the CPU 201 in the delay synchronization process. FIG. 10A illustrates a CPU_FREE_TIMER register that gives the value of the free-running timer counter 302 of the CPU 201 and a CPU_TIMER_COUNT register that gives the maximum sequence clock count set to the sequence clock counter 301 of the CPU 201. FIG. 10B illustrates a list of registers in the DSP 206 that the CPU 201 uses when communicating with the DSP 206. These registers can be accessed as memory from the CPU 201 via the CPU I/F 215 (see FIG. 2). The data structures introduced above will be described in more detail later.

Figure 11:
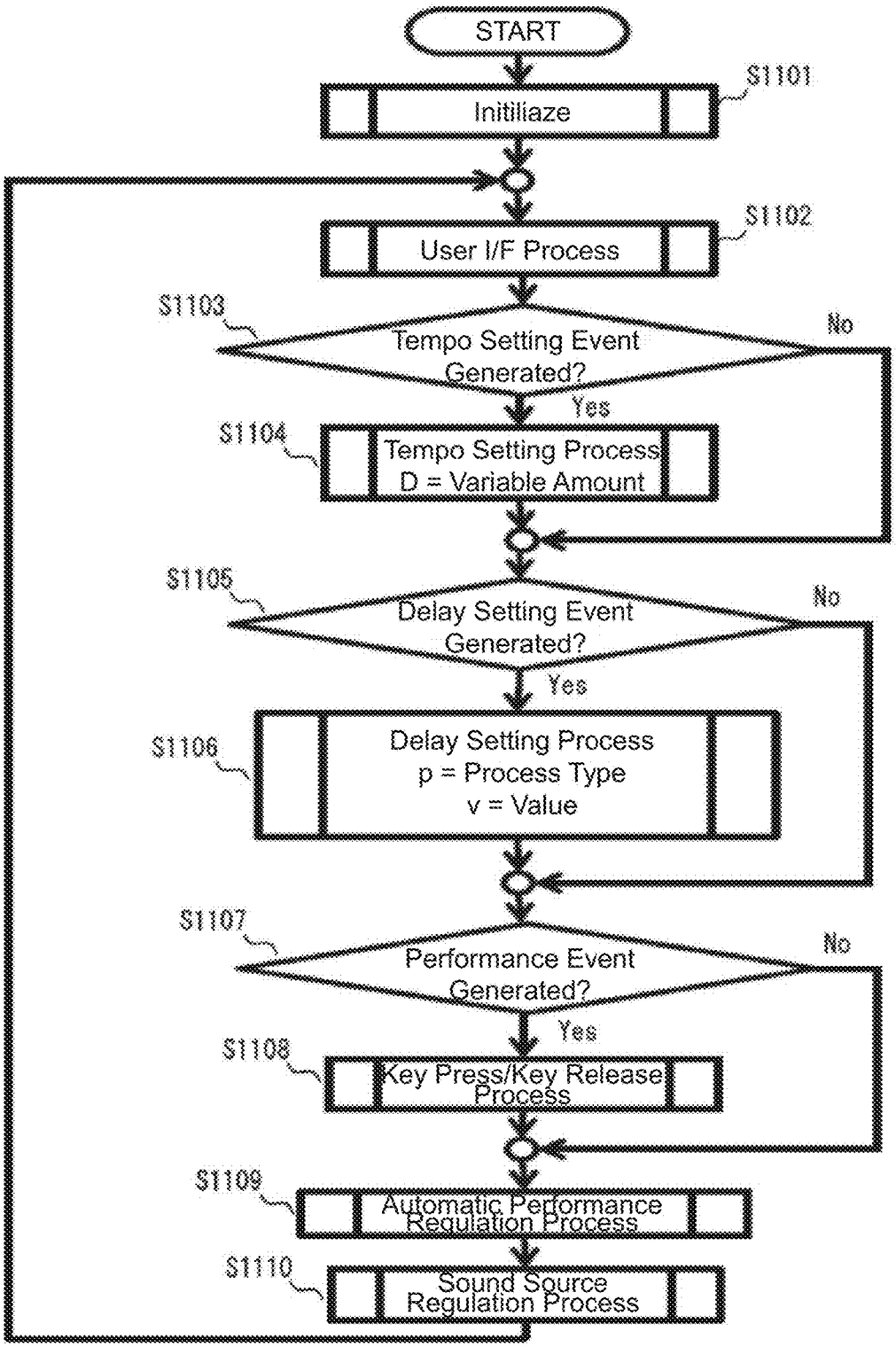
FIG. 11 is a flowchart illustrating an example of an overall electronic musical instrument control process, which is executed by the CPU 201.

FIG. 11 is a flowchart illustrating an example of an overall electronic musical instrument control process according to the present embodiment, which is executed by the CPU 201.

Once powered on, in step S1101 the CPU 201 first executes an initialization process. The details of this initialization process will be described later as part of the description of the flowchart illustrated in FIG. 12.

After the initialization process, the CPU 201 enters an infinite loop in which the processes from step S1102 to step S1110 are repeatedly executed in order. First, in step S1102, the CPU 201 executes a user interface process (hereinafter, "user I/F process") to detect user operations on the keyboard 101, the feature selection controls 102, the tone selection buttons 103, and the bender/modulation wheels 104 illustrated in FIG. 1.

Next, in step S1103, the CPU 201 determines, according to the results of the user I/F process from step S1102, whether a tempo configuration event occurred due to the user pressing the DOWN button or the UP button in the TEMPO area of the feature selection controls 102 illustrated in FIG. 1. If the result of this determination is affirmative (hereinafter, "Yes"), the CPU 201 proceeds to step S1104 and executes a tempo configuration process. Here, the CPU 201 sets the tempo change amount, as obtained from the key scanner 211 and resulting from the user pressing the DOWN button or the UP button in the TEMPO area of the feature selection controls 102, to a variable D in the CPU RAM 203. If the UP button was pressed, the CPU 201 sets D=+1, and if the DOWN button was pressed, the CPU 201 sets D=−1. The details of the tempo configuration process will be described later as part of the description of the flowchart illustrated in FIG. 13. If the result of the determination in step S1103 is negative (hereinafter, "No"), the CPU 201 skips step S1104 and does not execute the tempo configuration process.

Next, in step S1105, the CPU 201 determines, according to the results of the user I/F process from step S1102, whether a delay configuration event occurred due to the user operating any of the buttons or knobs in the DELAY area of the feature selection controls 102. If the result of this determination is Yes, the CPU 201 proceeds to step S1106 and executes a delay configuration process. Here, the CPU 201 respectively sets the operation type and the operation value corresponding to the change made to a button or knob, as obtained from the key scanner 211 and resulting from the user operating that button or knob in the DELAY area of the feature selection controls 102, to a variable p and a variable v in the CPU RAM 203. The details of the delay configuration process will be described later as part of the description of the flowcharts illustrated in FIGS. 14 to 16B. If the result of the determination in step S1106 is No, the CPU 201 skips step S1106 and does not execute the delay setting change process.

Next, in step S1107, the CPU 201 determines, according to the results of the user I/F process from step S1102, whether a performance event occurred due to the user operating the keyboard 101 or whether MIDI input corresponding to a key press or a key release was received via the MIDI I/F 214. If the result of this determination is Yes, the CPU 201 proceeds to step S1108 and executes a key press/key release process. Here, the CPU 201 issues a note-on event (an instruction to emit a sound) or a note-off event (an instruction to silence the sound) to the waveform generator 205 of the sound source LSI 204 on the basis of pitch information and velocity information as obtained from the key scanner 211 and resulting from the user operating the keyboard 101, or on the basis of pitch information and velocity information of MIDI data corresponding to a note-on event as obtained via the MIDI I/F 214, for example. This is a conventional process, and therefore further details about this process will be omitted here. If the result of the determination in step S1107 is No, the CPU 201 skips step S1108 and does not execute the delay setting change process.

Next, the CPU 201 proceeds to step S1109 and executes an automatic performance regulation process. The automatic performance regulation process advances the automatic performance according to the sequence clock interrupts described above. The details of the automatic performance regulation process will be described later as part of the description of the flowchart illustrated in FIG. 17.

Next, the CPU 201 proceeds to step S1110 and executes a sound source regulation process. In the sound source regulation process, instructions for processes such as tone changes corresponding to presses of the tone selection buttons 103 illustrated in FIG. 1 or velocity changes/pitch changes corresponding to operations on the bender/modulation wheels 104 illustrated in FIG. 1, for example, are sent to the sound source LSI 204. This is a conventional process, and therefore further details about this process will be omitted here.

Figure 12:
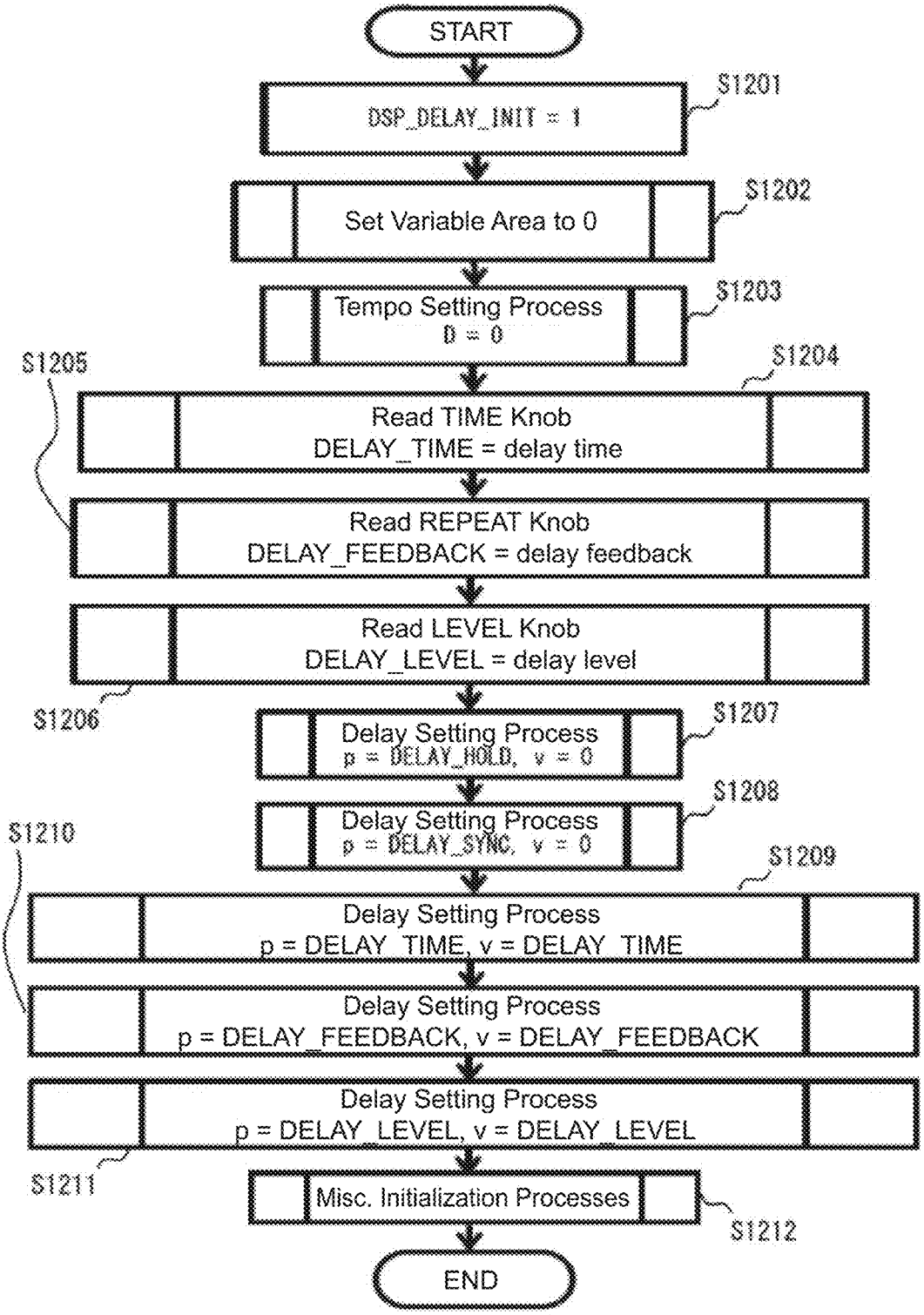
FIG. 12 is a flowchart illustrating a detailed example of an initialization process.

FIG. 12 is a flowchart illustrating a detailed example of the initialization process of step S1101 in FIG. 11.

As illustrated in FIG. 12, in step S1201, the CPU 201 first writes, via the CPU I/F 215, a value of 1 to a DSP_DELAY_INIT register (see FIG. 10B) in the DSP 206, which executes the delay process within the sound source LSI 204. When the value of the DSP_DELAY_INIT register is set to 1, the DSP 206 initializes the contents of the DSP RAM 208 (the delay memory) that is connected to the DSP 206, the value of the pointer generated by the write pointer generator 605, and the like. The DSP 206 then resets the value of the DSP_DELAY_INIT register to 0.

Next, in step S1202, the CPU 201 initializes the values of each variable (see the list in FIG. 9B) in a variable region of the CPU RAM 203 to 0. As a result, the value of a SEQ_RUN variable that indicates whether an automatic performance is currently being played (see FIG. 9B) is initialized to 0, thereby setting the automatic performance to a stopped state. Moreover, the value of a DELAY_HOLD variable that indicates whether delay hold mode is currently enabled (see FIG. 9B) is initialized to 0, thereby disabling delay hold mode. Furthermore, the value of a DELAY_SYNC variable that indicates whether delay tempo synchronization mode is currently enabled (see FIG. 9B) is initialized to 0, thereby disabling delay tempo synchronization mode. In addition, the value of a SEQ_CLOCK sequence counter variable that indicates the current interrupt count of the sequence clock interrupts that are used to control the automatic performance is also initialized to 0. Moreover, a TEMPO variable that indicates the current tempo (see FIG. 9B) is set to an initial value of 120 (BPM).

Next, in step S1203, the CPU 201 executes the tempo configuration process. Here, the CPU 201 sets a tempo change amount of 0 to the variable D in the CPU RAM 203. The details of the tempo configuration process will be described later as part of the description of the flowchart illustrated in FIG. 13. In this process, the CPU 201 accesses the TEMPO_COUNT_TBL (FIG. 9A) stored in the CPU ROM 202 and uses the initial tempo value of 120 (BPM) that is set to the TEMPO variable in the CPU RAM 203 (see FIG.

9B) to get a SEQ_CLOCK_COUNT value of 1042 (see FIG. 5A). The CPU 201 then sets this value to the CPU_TIMER_COUNT register (see FIG. 10A) of the CPU 201 (see step S1306 in FIG. 13). This CPU_TIMER_COUNT register value of 1042 is then set to the sequence clock counter 301 of the CPU 201 as the initial maximum sequence clock count.

Next, in step S1204, the CPU 201 reads the position of the TIME knob in the DELAY area of the feature selection controls 102 illustrated in FIG. 1 from the key scanner 211 illustrated in FIG. 2 and stores this value in a DELAY_TIME variable in the CPU RAM 203 that indicates the current delay time (see FIG. 9B). The value range for the delay time is 0-FFFFH (where "H" indicates hexadecimal notation), which corresponds to a time range of 0 to 2000 msec. Therefore, equation (11) below may be used to convert the DELAY_TIME to units of msec.

$$\text{Delay time (msec)}=\text{DELAY_TIME}\times 2000/\text{FFFFH} \quad (11)$$

Next, in step S1205, the CPU 201 reads the position of the REPEAT knob in the DELAY area of the feature selection controls 102 illustrated in FIG. 1 from the key scanner 211 illustrated in FIG. 2 and stores this value in a DELAY_FEEDBACK variable in the CPU RAM 203 that indicates the current delay feedback amount (see FIG. 9B).

Then, in step S1206, the CPU 201 reads the position of the LEVEL knob in the DELAY area of the feature selection controls 102 illustrated in FIG. 1 from the key scanner 211 illustrated in FIG. 2 and stores this value in a DELAY_LEVEL variable in the CPU RAM 203 that indicates the current level of the delay sound (see FIG. 9B).

Next, in step S1207, the CPU 201 sets a string 'DELAY_HOLD' that indicates delay hold mode to the parameter variable p in the CPU RAM 203, sets a value of 0 to the value variable v to indicate that delay hold mode is currently disabled, and then executes the delay configuration process. When p is set to 'DELAY_HOLD', the CPU 201 proceeds to step S1402 (described later) in the flowchart in FIG. 14 (which illustrates the details of the delay configuration process) and executes the delay hold mode configuration process (HOLD process) illustrated in the flowchart in FIG. 15A. In this way, in accordance with the fact that delay hold mode is currently disabled, a DSP_DELAY_INPUT register in the DSP 206 (see FIG. 10B) that indicates the current gain of the delay input volume adjustment amplifier 402 (see FIG. 4A) is initially set to a value of FFFFH (a gain of 1.0). Moreover, a DSP_DELAY_FEEDBACK register in the DSP 206 that indicates the current gain of the feedback amount adjustment amplifier 404 (see FIG. 4A) is initially set to the initial operation value of the REPEAT knob that was set to the DELAY_FEEDBACK variable in the CPU RAM 203 in step S1205 of FIG. 12 (see step S1503 in FIG. 15A).

Next, in step S1208, the CPU 201 sets a string 'DELAY_SYNC' that indicates delay tempo synchronization mode to the parameter variable p in the CPU RAM 203, sets a value of 0 to the value variable v to indicate that delay tempo synchronization mode is currently disabled, and then executes the delay configuration process. When p is set to 'DELAY_SYNC', the CPU 201 proceeds to step S1406 (described later) in the flowchart in FIG. 14 (which illustrates the details of the delay configuration process) and executes the delay tempo synchronization mode configuration process (SYNC process) illustrated in the flowchart in FIG. 16A. In this way, in accordance with the fact that delay synchronization mode is currently disabled, a DSP_DELAY_SAMPLE register in the DSP 206 (see FIG. 10B) that corresponds to the delay time sampling count register 602 described above (see FIG. 6) is initially set to a sample count obtained by sampling, using the 44.1 kHz sampling clock in the DSP 206, the time value corresponding to the initial operation value of the TIME knob that was set to the DELAY_TIME variable in the CPU RAM 203 in step S1204 of FIG. 12 (see equation (11) above and step S1604 in FIG. 16A).

Next, in step S1209, the CPU 201 sets a string 'DELAY_TIME' that indicates a delay time to the parameter variable p in the CPU RAM 203, sets the value of the DELAY_TIME variable in the CPU RAM 203 to the value variable v, and then executes the delay configuration process. When p is set to 'DELAY_TIME', the CPU 201 proceeds to step S1403 (described later) in the flowchart in FIG. 14 (which illustrates the details of the delay configuration process) and executes the delay time configuration process (TIME process) illustrated in the flowchart in FIG. 15B. In this way, the DSP_DELAY_SAMPLE register in the DSP 206 (see FIG. 10B) that corresponds to the delay time sampling count register 602 described above (see FIG. 6) is initially set to a sample count obtained by sampling, using the 44.1 kHz sampling clock in the DSP 206, the time value corresponding to the current value of the TIME knob that is set to the DELAY_TIME variable in the CPU RAM 203 (see equation (11) above and steps S1511 and S1513 in FIG. 15B).

Next, in step S1210, the CPU 201 sets a string 'DELAY_FEEDBACK' that indicates a delay feedback to the parameter variable p in the CPU RAM 203, sets the value of the DELAY_FEEDBACK variable in the CPU RAM 203 to the value variable v, and then executes the delay configuration process. When p is set to 'DELAY_FEEDBACK', the CPU 201 proceeds to step S1404 (described later) in the flowchart in FIG. 14 (which illustrates the details of the delay configuration process) and executes the delay feedback configuration process (FEEDBACK process) illustrated in the flowchart in FIG. 15C. In this way, the DSP_DELAY_FEEDBACK register in the DSP 206 (see FIG. 10B) that indicates the current gain of the feedback amount adjustment amplifier 404 (see FIG. 4A) is initially set to the feedback amount corresponding to the initial operation value of the REPEAT knob that was set to the DELAY_FEEDBACK variable in the CPU RAM 203 in step S1205 of FIG. 12.

Next, in step S1211, the CPU 201 sets a string 'DELAY_LEVEL' that indicates a delay level to the parameter variable p in the CPU RAM 203, sets the value of the DELAY_LEVEL variable in the CPU RAM 203 to the value variable v, and then executes the delay configuration process. When p is set to 'DELAY_LEVEL', the CPU 201 proceeds to step S1405 (described later) in the flowchart in FIG. 14 (which illustrates the details of the delay configuration process) and executes the delay level configuration process (LEVEL process) illustrated in the flowchart in FIG. 15D. In this way, a DSP_DELAY_OUTPUT register in the DSP 206 (see FIG. 10B) that indicates the current gain of the delay output volume adjustment amplifier 403 (see FIG. 4A) is initially set to the level corresponding to the initial operation value of the LEVEL knob that was set to the DELAY_LEVEL variable in the CPU RAM 203 in step S1206 of FIG. 12.

Finally, in step S1212, the CPU 201 executes other initialization processes that initialize items that are not related to the delay synchronization process of the present embodiment, such as other variables in the CPU RAM 203 and other registers in the sound source LSI 204. The CPU 201 then completes the initialization process of step S1101 of FIG. 11 and illustrated in the flowchart in FIG. 12.

Figure 13:
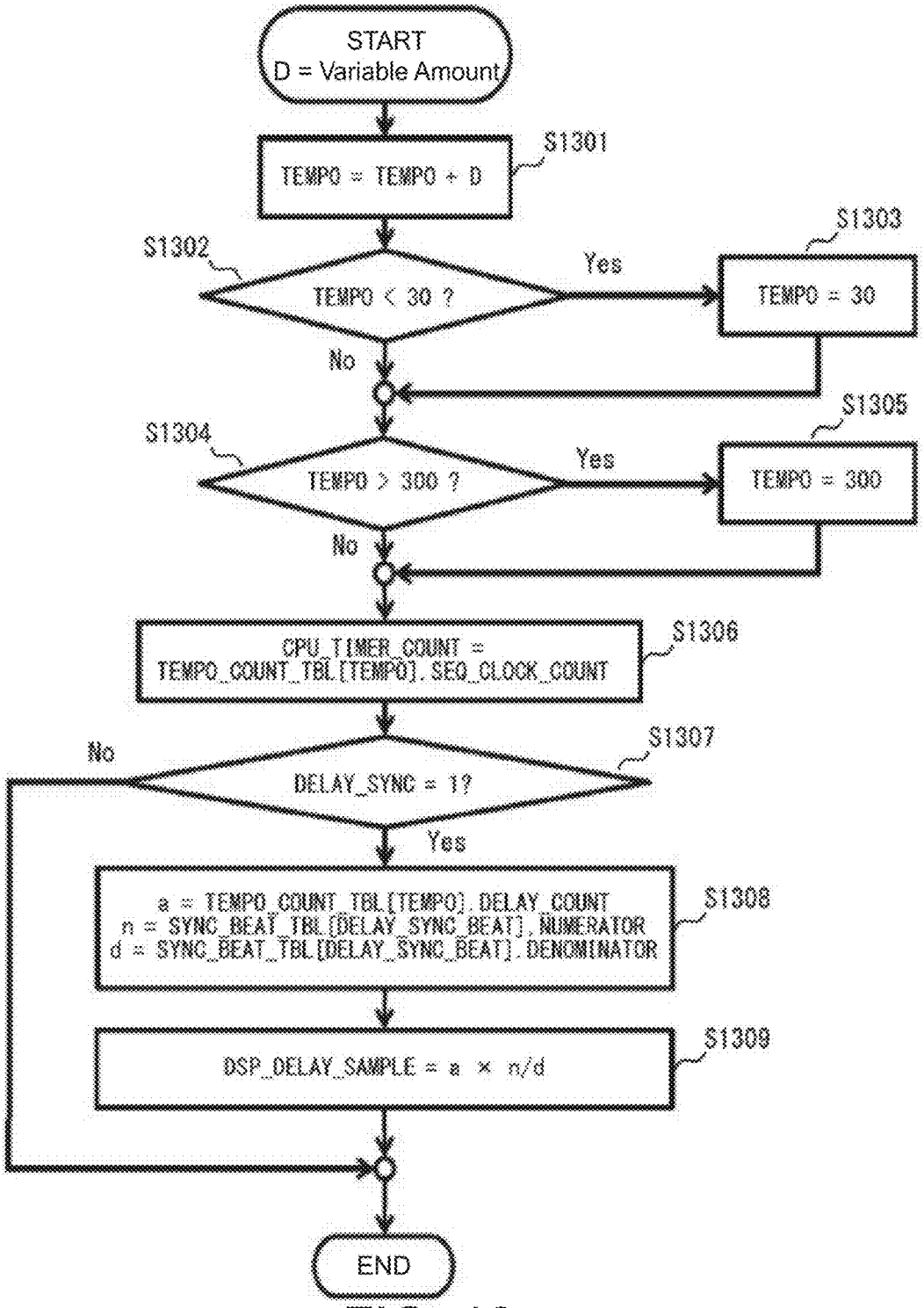
FIG. 13 is a flowchart illustrating a detailed example of a tempo configuration process.

FIG. 13 is a flowchart illustrating a detailed example of the tempo configuration process executed in step S1104 of FIG. 11 or in step S1203 of FIG. 12 as part of the initialization process of step S1101.

As illustrated in FIG. 13, in step S1301, the CPU 201 changes the tempo value by adding or subtracting, to or from the tempo value stored in the TEMPO variable in the CPU RAM 203, the tempo operation amount passed from the variable D in the CPU RAM 203. If the user pressed the UP key in the TEMPO area of the feature selection controls 102 illustrated in FIG. 1, D=+1 is passed and the value of the TEMPO variable is increased by 1. If the user pressed the DOWN key in the TEMPO area, D=−1 is passed and the value of the TEMPO variable is decreased by 1.

Next, in step S1302, the CPU 201 determines whether the new value of the TEMPO variable is less than the minimum value of 30. If the result of the determination in step S1302 is Yes, the CPU 201 proceeds to step S1303 and sets the value of the TEMPO variable to the minimum value of 30. If the result of the determination in step S1302 is No, the CPU 201 skips and does not execute step S1303.

Next, in step S1304, the CPU 201 determines whether the new value of the TEMPO variable is greater than the maximum value of 300. If the result of the determination in step S1304 is Yes, the CPU 201 proceeds to step S1305 and sets the value of the TEMPO variable to the maximum value of 300. If the result of the determination in step S1304 is No, the CPU 201 skips and does not execute step S1305.

Then, in step S1306, the CPU 201 accesses the TEMPO_COUNT_TBL (FIG. 9A) stored in the CPU ROM 202 and uses the value of the TEMPO variable as updated in steps S1301 to S1305 to get the SEQ_CLOCK_COUNT value from the entry that has the corresponding TEMPO value (see FIG. 5A). The CPU 201 then sets this SEQ_CLOCK_COUNT value to the CPU_TIMER_COUNT register (see FIG. 10A) of the CPU 201. The updated value of the CPU_TIMER_COUNT register is then set to the sequence clock counter 301 of the CPU 201 as the new maximum sequence clock count.

Next, in step S1307, the CPU 201 determines whether the value of the DELAY_SYNC variable in the CPU RAM 203 is currently 1 (that is, whether delay hold mode is currently enabled).

If the result of the determination in step S1307 is Yes, the CPU 201 proceeds to step S1308 and first accesses the TEMPO_COUNT_TBL (FIG. 9A) stored in the CPU ROM 202, using the value of the TEMPO variable as updated in steps S1301 to S1305 to get the DELAY_COUNT value from the entry that has the corresponding TEMPO value (that is, the TEMPO_COUNT_TBL(TEMPO).DELAY_COUNT value, which corresponds to the sampling clock count when the delay time is synchronized to one beat of the updated tempo value). The CPU 201 then stores this DELAY_COUNT value in a variable a in the CPU RAM 203. Then, the CPU 201 accesses the SYNC_BEAT_TBL (FIG. 9A) stored in the CPU ROM 202 and uses the setting that was selected by the user with the BEAT knob in the DELAY area of the feature selection controls 102 illustrated in FIG. 1 and that was stored in the DELAY_SYNC_BEAT variable in the CPU RAM 203 to get the NUMERATOR value and the DENOMINATOR value from the entry that has the corresponding DELAY_SYNC_BEAT value (that is, the SYNC_BEAT_TBL(DELAY_SYNC_BEAT).NUMERATOR and SYNC_BEAT_TBL(DELAY_SYNC_BEAT).DENOMINATOR values, respectively). The CPU 201 then stores the NUMERATOR value and the DENOMINATOR value in variables n and d in the CPU RAM 203, respectively.

Next, in step S1309, the CPU 201 uses equation (12) below to calculate the delay time sampling count 608 (which is the maximum count for the delay time counter 601; see FIG. 6) and stores the calculated value in the DSP_DELAY_SAMPLE register in the DSP 206 (see FIG. 10B) that corresponds to the delay time sampling count register 602 (see FIG. 6).

$$\text{DSP_DELAY_SAMPLE}=a\times n/d \tag{12}$$

In steps S1308 and S1309, the delay time sampling count 608 corresponding to the delay time of the specified synchronization beat count of the specified tempo is calculated and then stored in the DSP_DELAY_SAMPLE register in DSP 206. Then, the CPU 201 completes the tempo configuration process illustrated in the flowchart in FIG. 13.

If the result of the determination in step S1307 is No, the CPU 201 skips and does not execute steps S1308 and S1309 and then completes the tempo configuration process illustrated in the flowchart in FIG. 13.

Figure 14:
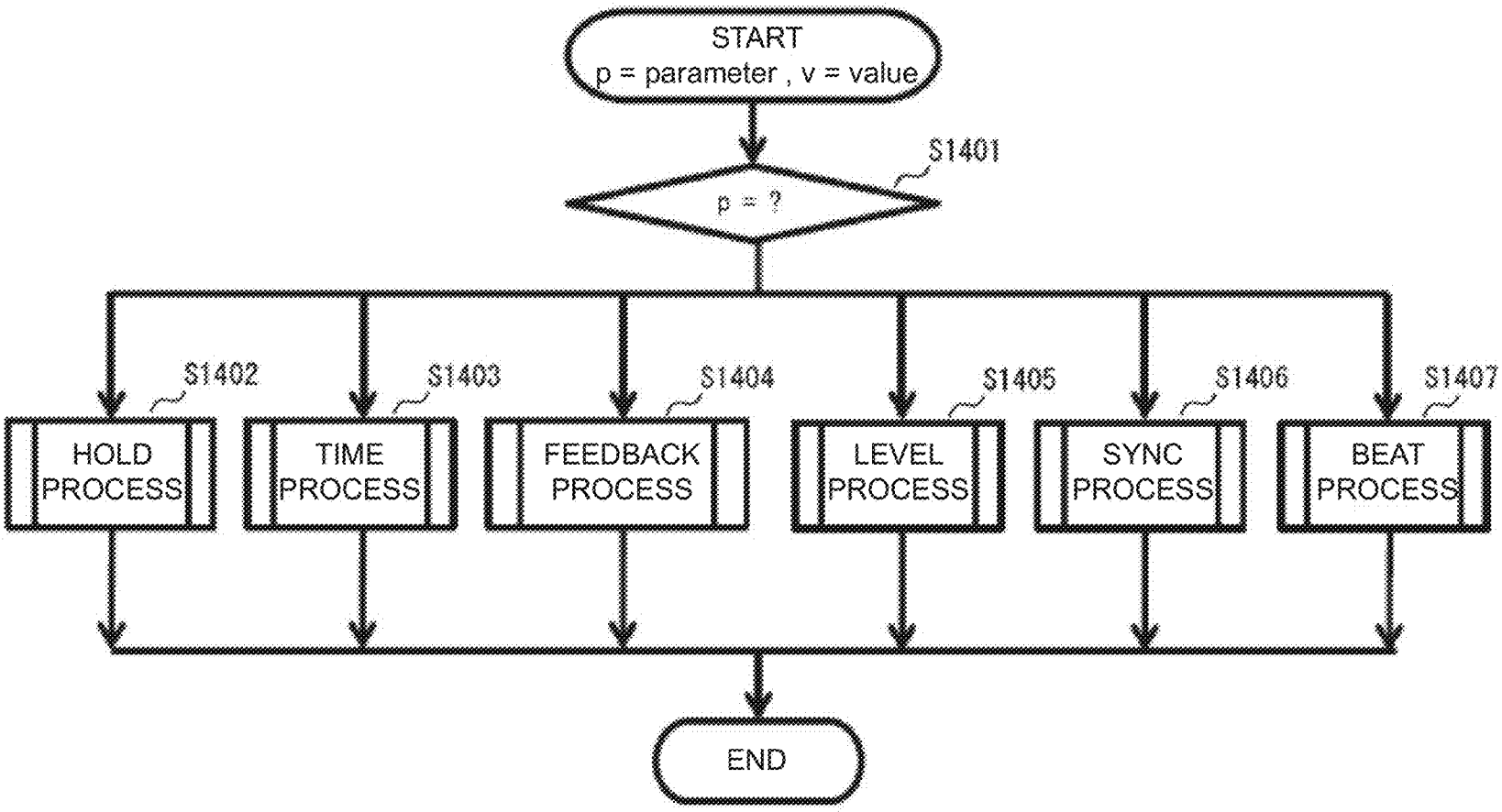
FIG. 14 is a flowchart illustrating a detailed example of a delay configuration process.

FIG. 14 is a flowchart illustrating a detailed example of the delay configuration process executed in step S1106 of FIG. 11 or in steps S1207 to S1211 of FIG. 12 as part of the initialization process of step S1101.

As illustrated in FIG. 14, in step S1401, the CPU 201 first determines the type of configuration process passed from the variable p in the CPU RAM 203 (that is, the type of operation that the user performed using the controls in the DELAY area of the feature selection controls 102 illustrated in FIG. 1).

If the variable p='DELAY_HOLD' (that is, if the HOLD button was pressed), the CPU 201 proceeds to step S1402 and executes the delay hold mode configuration process (the HOLD process). Here, if the HOLD button LED was off when the HOLD button was pressed, the variable v is set to a value of 1 to indicate that delay hold mode was switched from disabled to enabled. Conversely, if the HOLD button LED was on when the HOLD button was pressed, the variable v is set to a value of 0 to indicate that delay hold mode was switched from enabled to disabled.

If the variable p='DELAY_TIME' (that is, if the TIME knob was operated), the CPU 201 proceeds to step S1403 and executes the delay time configuration process (the TIME process). Here, the variable v is set to a value in the range of 0-FFFFH that corresponds to the position of the TIME knob.

If the variable p='DELAY_FEEDBACK' (that is, if the REPEAT knob was operated), the CPU 201 proceeds to step S1404 and executes the delay feedback configuration process (the FEEDBACK process). Here, the variable v is set to a value in the range of 0-FFFFH that corresponds to the position of the REPEAT knob.

If the variable p='DELAY_LEVEL' (that is, if the LEVEL knob was operated), the CPU 201 proceeds to step S1405 and executes the delay level configuration process (the LEVEL process). Here, the variable v is set to a value in the range of 0-FFFFH that corresponds to the position of the LEVEL knob.

If the variable p='DELAY_SYNC' (that is, if the SYNC button was pressed), the CPU 201 proceeds to step S1406 and executes the delay tempo synchronization mode configuration process (the SYNC process). Here, if the SYNC button LED was off when the SYNC button was pressed, the variable v is set to a value of 1 to indicate that delay tempo synchronization mode was switched from disabled to enabled. Conversely, if the SYNC button LED was on when the SYNC button was pressed, the variable v is set to a value of 0 to indicate that delay tempo synchronization mode was switched from enabled to disabled.

If the variable p='DELAY_BEAT' (that is, if the BEAT knob was operated), the CPU 201 proceeds to step S1407 and executes the delay tempo synchronization beat count configuration process (the BEAT process). Here, the variable v is set to one of the settings 0, 1, 2, 3, 4, 5, 6, or 7 that corresponds to the position of the BEAT knob.

After each configuration process is completed, the CPU 201 completes the delay configuration process illustrated in the flowchart in FIG. 14.

Figure 15A:
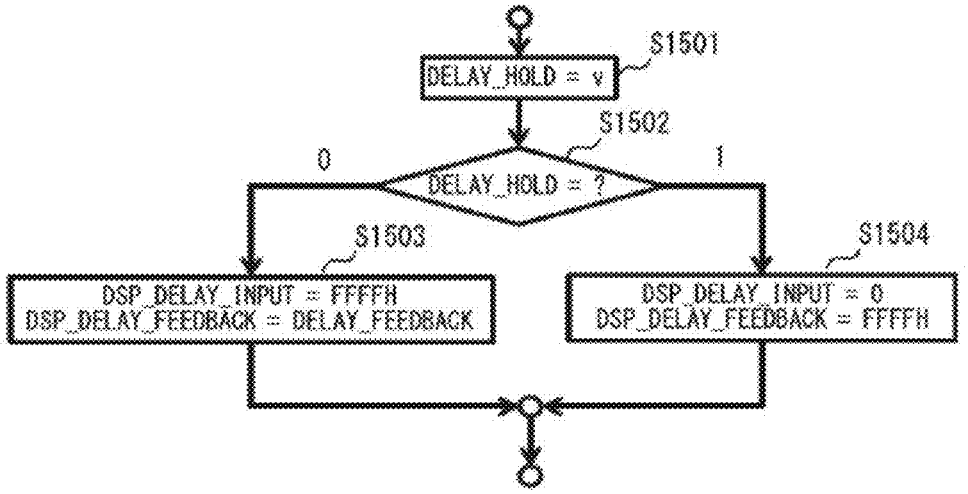
FIGS. 15A to 15D contain flowcharts respectively illustrating detailed examples of a delay hold mode configuration process (a HOLD process), a delay time configuration process (a TIME process), a delay feedback configuration process (a FEEDBACK process), and a delay level configuration process (a LEVEL process).

FIG. 15A is a flowchart illustrating a detailed example of the delay hold mode configuration process (the HOLD process) of step S1402 in FIG. 14. This process is executed if the user pressed the HOLD button in the DELAY area of the feature selection controls 102 illustrated in FIG. 1. By pressing the HOLD button and illuminating or turning off the HOLD button LED, the user can enable/disable delay hold mode. Here, as described above, if the HOLD button LED was off when the HOLD button was pressed, the variable v is set to a value of 1 to indicate that delay hold mode was switched from disabled to enabled. Conversely, if the HOLD button LED was illuminated when the HOLD button was pressed, the variable v is set to a value of 0 to indicate that delay hold mode was switched from enabled to disabled.

First, in step S1501, the CPU 201 sets the value of the variable v to the DELAY_HOLD variable that indicates whether delay hold mode is currently enabled (see FIG. 9B).

Next, in step S1502, the CPU 201 determines what value was set to the DELAY_HOLD variable in step S1501.

If, in step S1502, the CPU 201 determines that a value of 0 was set to the DELAY_HOLD variable (that is, that delay hold mode is currently disabled), the CPU 201 proceeds to step S1503 and sets a value of FFFFH (a gain of 1.0) to the DSP_DELAY_INPUT register in the DSP 206 (see FIG. 10B) that indicates the current gain of the delay input volume adjustment amplifier 402 (see FIG. 4A). When this happens, the amplification factor of the delay input volume adjustment amplifier 402 is set to 1.0, and the delay effect is applied to any subsequently input audio signals 407. Moreover, the CPU 201 also sets the feedback amount currently set to the DELAY_FEEDBACK variable in the CPU RAM 203 to the DSP_DELAY_FEEDBACK register in the DSP 206 (see FIG. 10B) that indicates the current gain of the feedback amount adjustment amplifier 404 (see FIG. 4A). This enables adjustment of the feedback amount using the REPEAT knob in the DELAY area of the feature selection controls 102 illustrated in FIG. 1. The CPU 201 then completes the delay hold mode configuration process (the HOLD process) of step S1402 of FIG. 14 and illustrated in the flowchart in FIG. 15A.

If, in step S1502, the CPU 201 determines that a value of 1 was set to the DELAY_HOLD variable (that is, that delay hold mode is currently enabled), the CPU 201 sets a value of 0 to the DSP_DELAY_INPUT register in the DSP 206 (see FIG. 10B) that indicates the current gain of the delay input volume adjustment amplifier 402 (see FIG. 4A). In other words, in FIG. 4A, once delay hold mode is enabled, no new audio signal input 407 is input to the delay device 401. Moreover, the CPU 201 also sets a value of FFFFH (a gain of 1.0) to the DSP_DELAY_FEEDBACK register in the DSP 206 (see FIG. 10B) that indicates the current gain of the feedback amount adjustment amplifier 404 (see FIG. 4A). In other words, in FIG. 4A, once delay hold mode is enabled, 100% of the audio signal output from the delay device 401 is fed back into the input side of the delay device 401. In this way, the sample looper functionality described above is implemented. The CPU 201 then completes the delay hold mode configuration process (the HOLD process) of step S1402 of FIG. 14 and illustrated in the flowchart in FIG. 15A.

Figure 15B:
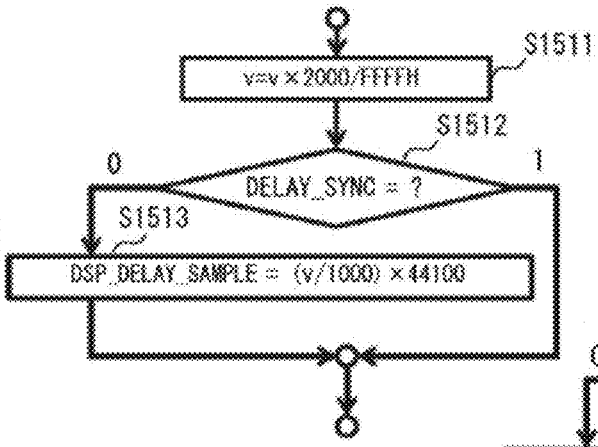

FIG. 15B is a flowchart illustrating a detailed example of the delay time configuration process (the TIME process) of step S1403 in FIG. 14. This process is executed if the user operated the TIME knob in the DELAY area of the feature selection controls 102 illustrated in FIG. 1. When the LED of the SYNC button in the DELAY area is turned off and delay tempo synchronization mode is therefore disabled, the user can use the TIME knob to directly specify a delay time of 0 to 2 sec, for example. Here, as described above, the variable v is set to a value in the range of 0-FFFFH that corresponds to the position of the TIME knob.

First, in step S1511, the CPU 201 uses equation (11) from above to convert the value of the DELAY_TIME variable as passed from the variable v from a hexadecimal value to a value in units of msec and then stores this new value back in the variable v.

Next, in step S1512, the CPU 201 determines the value of the DELAY_SYNC variable in the CPU RAM 203.

If, in step S1512, the CPU 201 determines that a value of 0 is set to the DELAY_SYNC variable (that is, that delay tempo synchronization mode is currently disabled), the CPU 201 proceeds to step S1513 and evaluates equation (13) below.

$$\text{DSP_DELAY_SAMPLE}=(v/1000)\times 44100 \tag{13}$$

In this way, the DSP_DELAY_SAMPLE register in the DSP 206 (see FIG. 10B) that corresponds to the delay time sampling count register 602 (see FIG. 6) is set to a sample count obtained by sampling, using the 44.1 kHz sampling clock in the DSP 206, the time value corresponding to the current value of the TIME knob that is set to the DELAY_TIME variable in the CPU RAM 203. The CPU 201 then completes the delay time configuration process (the TIME process) of step S1403 of FIG. 14 and illustrated in the flowchart in FIG. 15B.

If, in step S1512, the CPU 201 determines that a value of 1 is set to the DELAY_SYNC variable (that is, that delay tempo synchronization mode is currently enabled), the delay time is synchronized to and determined by the tempo and TIME knob operations are ignored, as described above. Therefore, the CPU 201 immediately completes the delay time configuration process (the TIME process) of step S1403 of FIG. 14 and illustrated in the flowchart in FIG. 15B.

Figure 15C:
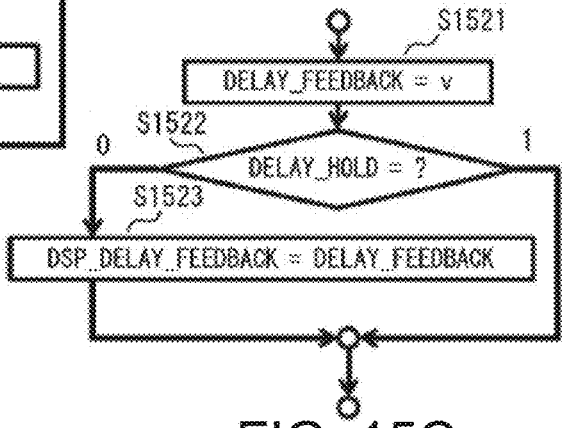

FIG. 15C is a flowchart illustrating a detailed example of the delay feedback configuration process (the FEEDBACK process) of step S1404 in FIG. 14. This process is executed if the user operated the REPEAT knob in the DELAY area of the feature selection controls 102 illustrated in FIG. 1. When the LED of the HOLD button in the DELAY area is turned off and delay hold mode is therefore disabled, the user can use the REPEAT knob to adjust the delay feedback amount. The value specified here determines the gain of the feedback amount adjustment amplifier 404 illustrated in FIG. 4A. Here, as described above, the variable v is set to a value in the range of 0-FFFFH that corresponds to the position of the REPEAT knob.

First, in step S1521, the CPU 201 stores the value of the variable v in the DELAY_FEEDBACK variable.

Next, in step S1522, the CPU 201 determines the value of the DELAY_HOLD variable in the CPU RAM 203.

If, in step S1522, the CPU 201 determines that a value of 0 is set to the DELAY_HOLD variable (that is, that delay hold mode is currently disabled), the CPU 201 proceeds to step S1523 and sets the feedback amount that is currently set to the DELAY_FEEDBACK variable to the DSP_DELAY_FEEDBACK register in the DSP 206 (see FIG. 10B) that indicates the current gain of the feedback amount adjustment amplifier 404 (see FIG. 4A) of the DSP 206. The CPU 201 then completes the delay feedback configuration process (the FEEDBACK process) of step S1404 of FIG. 14 and illustrated in the flowchart in FIG. 15C.

If, in step S1522, the CPU 201 determines that a value of 1 is set to the DELAY_HOLD variable (that is, that delay hold mode is currently enabled), this means that the maximum value of FFFFH was already set to the DSP_DELAY_FEEDBACK register in the DSP 206 as part of the delay hold mode configuration process (the HOLD process) in step S1504 of FIG. 15A. Therefore, the CPU 201 skips and does not execute the process in S1523 and then completes the delay feedback configuration process (the FEEDBACK process) of step S1404 of FIG. 14 and illustrated in the flowchart in FIG. 15C.

Figure 15D:
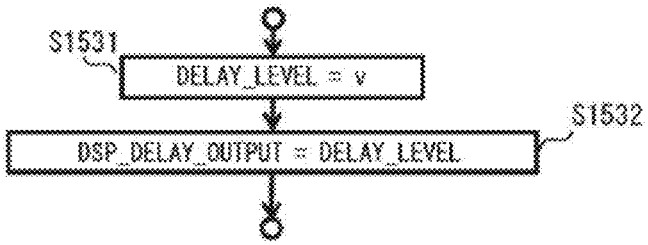

FIG. 15D is a flowchart illustrating a detailed example of the delay level configuration process (the LEVEL process) of step S1405 in FIG. 14. This process is executed if the user operated the LEVEL knob in the DELAY area of the feature selection controls 102 illustrated in FIG. 1. The user can use the LEVEL knob to adjust the level of the delay signal. The value specified here determines the gain of the delay output volume adjustment amplifier 403 illustrated in FIG. 4A. Here, as described above, the variable v is set to a value in the range of 0-FFFFH that corresponds to the position of the LEVEL knob.

First, in step S1531, the CPU 201 stores the value of the variable v in the DELAY_LEVEL variable.

Next, in step S1532, the DSP_DELAY_OUTPUT register in the DSP 206 (see FIG. 10B) that indicates the current gain of the delay output volume adjustment amplifier 403 (see FIG. 4A) is set to the level corresponding to the current value of the LEVEL knob that was set to the DELAY_LEVEL variable. The CPU 201 then completes the delay level configuration process (the LEVEL process) of step S1405 of FIG. 14 and illustrated in the flowchart in FIG. 15D.

Figure 16A:
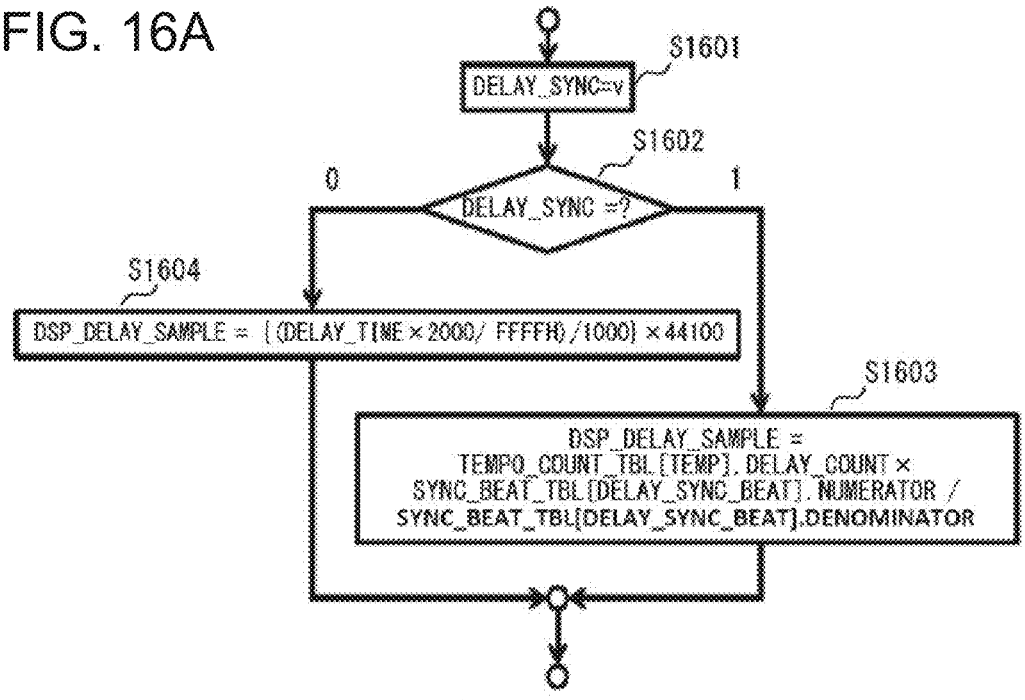
FIGS. 16A and 16B contain flowcharts respectively illustrating detailed examples of a delay tempo synchronization mode configuration process (a SYNC process) and a delay synchronization beat mode r (a BEAT process).

FIG. 16A is a flowchart illustrating a detailed example of the delay tempo synchronization mode configuration process (the SYNC process) of step S1406 in FIG. 14. This process is executed if the user pressed the SYNC button in the DELAY area of the feature selection controls 102 illustrated in FIG. 1. By pressing the SYNC button and illuminating or turning off the SYNC button LED, the user can enable/disable delay tempo synchronization mode. Here, as described above, if the SYNC button LED was off when the SYNC button was pressed, the variable v is set to a value of 1 to indicate that delay tempo synchronization mode was switched from disabled to enabled. Conversely, if the SYNC button LED was illuminated when the SYNC button was pressed, the variable v is set to a value of 0 to indicate that delay tempo synchronization mode was switched from enabled to disabled.

First, in step S1601, the CPU 201 sets the value of the variable v to the DELAY_SYNC variable that indicates whether delay tempo synchronization mode is currently enabled (see FIG. 9B).

Next, in step S1602, the CPU 201 determines what value was set to the DELAY_SYNC variable in step S1601.

If, in step S1602, the CPU 201 determines that a value of 1 was set to the DELAY_SYNC variable (that is, that delay tempo synchronization mode is currently enabled), the CPU 201 proceeds to step S1603 and does the following. First, the CPU 201 accesses the TEMPO_COUNT_TBL (FIG. 9A) stored in the CPU ROM 202 and uses the tempo value that is currently set to the TEMPO variable to get the DELAY_COUNT value from the entry that has the corresponding TEMPO value (that is, the TEMPO_COUNT_TBL(TEMPO).DELAY_COUNT value, which corresponds to the sampling clock count when the delay time is synchronized to one beat of the current tempo value). Then, the CPU 201 accesses the SYNC_BEAT_TBL (FIG. 9A) stored in the CPU ROM 202 and uses the setting that was selected by the user with the BEAT knob in the DELAY area of the feature selection controls 102 illustrated in FIG. 1 and that was stored in the DELAY_SYNC_BEAT variable in the CPU RAM 203 to get the NUMERATOR value and the DENOMINATOR value from the entry that has the corresponding DELAY_SYNC_BEAT value (that is, the SYNC_BEAT_TBL(DELAY_SYNC_BEAT).NUMERATOR and SYNC_BEAT_TBL(DELAY_SYNC_BEAT).DENOMINATOR values, respectively). Next, the CPU 201 uses equation (14) below to calculate the delay time sampling count 608 (which is the maximum count for the delay time counter 601; see FIG. 6) and stores the calculated value in the DSP_DELAY_SAMPLE register in the DSP 206 (see FIG. 10B) that corresponds to the delay time sampling count register 602 (see FIG. 6).

$$\text{DSP_DELAY_SAMPLE}=\text{TEMPO_COUNT_TBL}(\text{TEMPO}).\text{DELAY_COUNT}\times\text{SYNC_BEAT_TBL}(\text{DELAY_SYNC_BEAT}).\text{NUMERATOR}/\text{SYNC_BEAT_TBL}(\text{DELAY_SYNC_BEAT}).\text{DENOMINATOR} \quad (14)$$

In this way, the delay time for the delay process in the DSP 206 is set to the delay time sampling count corresponding to the delay time of the specified synchronization beat count of the specified tempo as calculated by multiplying the sampling clock count DELAY_COUNT for when the delay time is synchronized to one beat of the specified tempo value (TEMPO) by the synchronization beat count division ratio NUMERATOR/DENOMINATOR set using the BEAT knob in DELAY area of the feature selection controls 102. The CPU 201 then completes the delay tempo synchronization mode configuration process (the SYNC process) of step S1406 of FIG. 14 and illustrated in the flowchart in FIG. 16A.

If, in step S1602, the CPU 201 determines that a value of 0 was set to the DELAY_SYNC variable (that is, that delay tempo synchronization mode is currently disabled), this means that operations of the TIME knob in the DELAY area of the feature selection controls 102 illustrated in FIG. 1 are enabled, and therefore the CPU 201 proceeds to step S1604 and evaluates equation (15) below (which includes the calculation from equation (11) as well).

$$\text{DSP_DELAY_SAMPLE}=\{(\text{DELAY_TIME}\times 2000/\text{FFFFH})/1000\}\times 44100 \quad (15)$$

In this way, the DSP_DELAY_SAMPLE register in the DSP 206 that corresponds to the delay time sampling count register 602 (see FIG. 6) is set to a sample count obtained by sampling, using the 44.1 kHz sampling clock in the DSP 206, the time value obtained by converting the current value of the TIME knob that is set to the DELAY_TIME variable in the CPU RAM 203 from a hexadecimal value to a value in units of msec. In other words, the delay time for the delay process in the DSP 206 is directly determined by operations on the TIME knob. The CPU 201 then completes the delay tempo synchronization mode configuration process (the SYNC process) of step S1406 of FIG. 14 and illustrated in the flowchart in FIG. 16A.

Figure 16B:
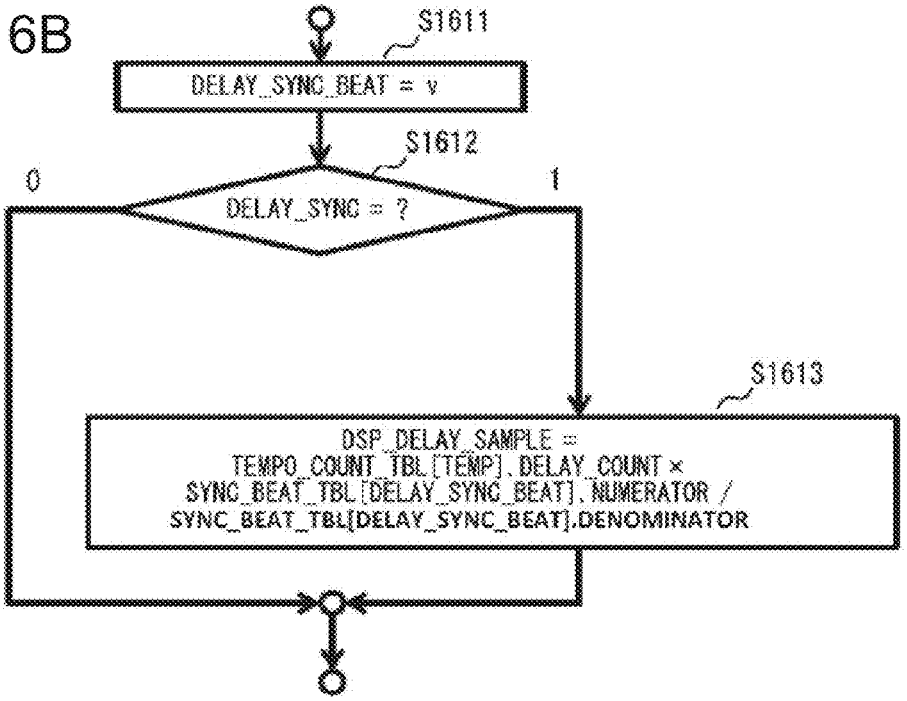

FIG. 16B is a flowchart illustrating a detailed example of the delay tempo synchronization beat count configuration process (the BEAT process) of step S1407 in FIG. 14. This process is executed if the user operated the BEAT knob in the DELAY area of the feature selection controls 102 illustrated in FIG. 1. The user can use the BEAT knob to specify the synchronization beat count used in delay tempo synchronization mode. Here, as described above, the variable v is set to one of the settings 0, 1, 2, 3, 4, 5, 6, or 7 that corresponds to the position of the BEAT knob.

First, in step S1611, the CPU 201 sets the value of the variable v to the DELAY_SYNC_BEAT variable that stores the synchronization beat count (see FIG. 9B).

Next, in step S1612, the CPU 201 determines what value is set to the DELAY_SYNC variable.

If, in step S1612, the CPU 201 determines that a value of 1 is set to the DELAY_SYNC variable (that is, that delay tempo synchronization mode is currently enabled), the CPU 201 proceeds to step S1613 and executes the same process as in step S1603 of FIG. 16A, which is executed as part of the delay tempo synchronization mode configuration process (the SYNC process). In this way, the DSP_DELAY_SAMPLE register in the DSP 206 (see FIG. 10B) that corresponds to the delay time sampling count register 602 (see FIG. 6) is set to the delay time for the delay process in the DSP 206 (that is, to the delay time sampling count corresponding to the delay time of the specified synchronization beat count of the specified tempo as calculated by multiplying the sampling clock count DELAY_COUNT for when the delay time is synchronized to one beat of the specified tempo value (TEMPO) by the synchronization beat count division ratio NUMERATOR/DENOMINATOR set using the BEAT knob in DELAY area of the feature selection controls 102). The CPU 201 then completes the delay tempo synchronization beat count configuration process (the BEAT process) of step S1407 of FIG. 14 and illustrated in the flowchart in FIG. 16B.

If, in step S1612, the CPU 201 determines that a value of 0 is set to the DELAY_SYNC variable (that is, that delay tempo synchronization mode is currently disabled), this means that BEAT knob operations are ignored. Therefore, the CPU 201 immediately completes the delay tempo synchronization beat count configuration process (the BEAT process) of step S1407 of FIG. 14 and illustrated in the flowchart in FIG. 16B.

Figure 17:
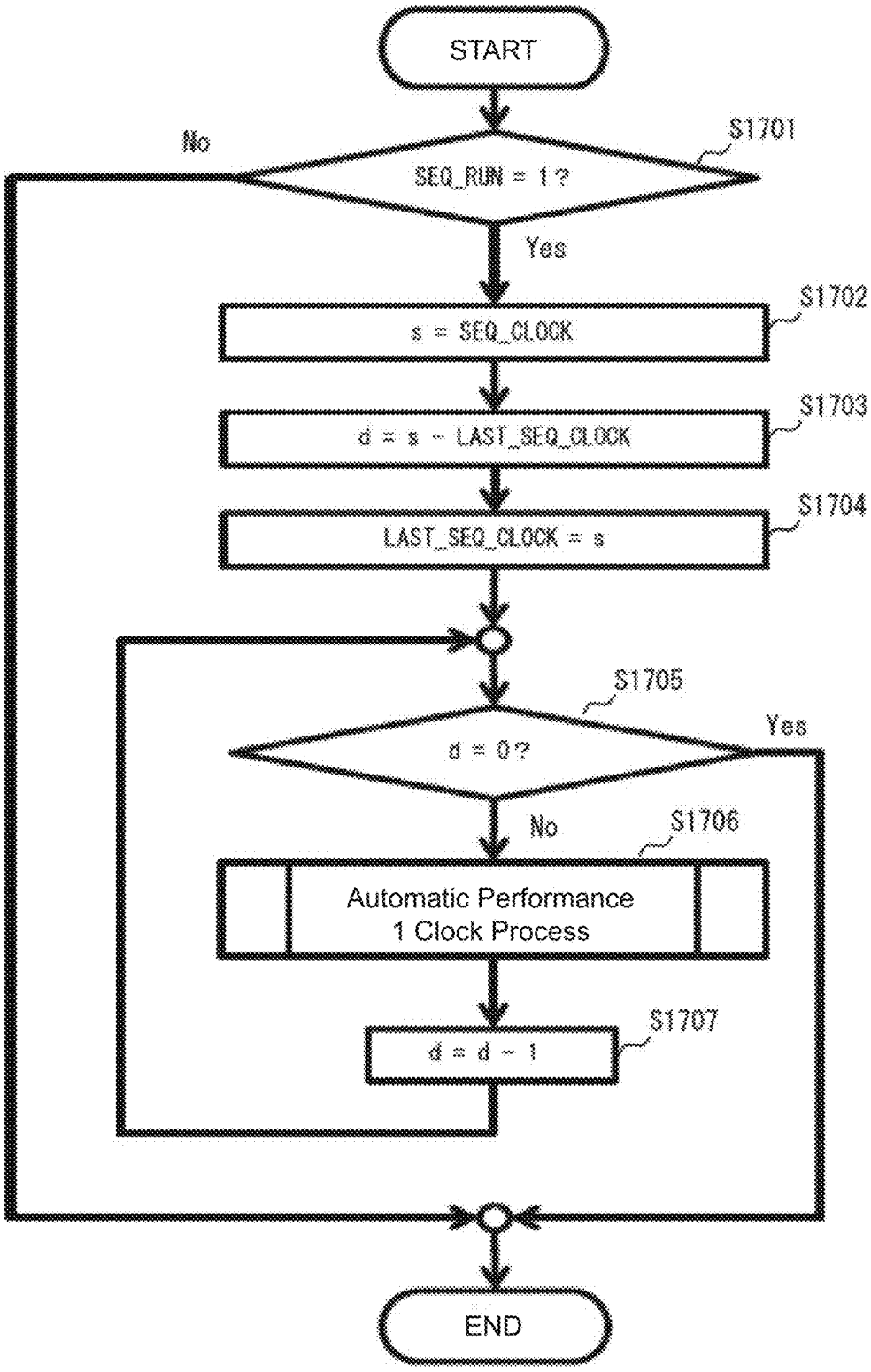
FIG. 17 is a flowchart illustrating a detailed example of an automatic performance regulation process.

FIG. 17 is a flowchart illustrating a detailed example of the automatic performance regulation process of step S1109 in FIG. 11. This process is implemented to control progression of the automatic performance in accordance with the sequence clock interrupts from the sequence clock counter 301 of the CPU 201 (FIG. 3).

First, in step S1701, the CPU 201 determines whether an automatic performance was specified according to whether the user operated an automatic performance specification switch (not illustrated in the figure) in the feature selection controls 102 illustrated in FIG. 1. Whether an automatic performance was specified can be determined from the value of the SEQ_RUN variable in the CPU RAM 203. If the SEQ_RUN variable is not 1, the automatic performance control process is not executed, and therefore the CPU 201 immediately completes the automatic performance regulation process of step S1109 of FIG. 11 and illustrated in the flowchart in FIG. 17.

If the value of the SEQ_RUN variable is 1, the CPU 201 proceeds to step S1702 and sets a variable s in the CPU RAM 203 to the value of the total sequence clock interrupt count variable SEQ_CLOCK that indicates the current total interrupt count of the sequence clock interrupts that are used to control the automatic performance (see FIG. 9B).

Next, in step S1703, the CPU 201 sets a variable din the CPU RAM 203 to a value obtained by subtracting, from the current total sequence clock interrupt count that was set to the variable s in step S1702, the value of a LAST_SEQ_CLOCK variable that stores the sequence counter value from when the last time the automatic performance regulation process of step S1109 of FIG. 11 was executed, as shown in equation (16) below. As a result, the variable d is set to the number of sequence clock interrupts that have occurred between the last time the automatic performance regulation process of step S1109 of FIG. 11 was executed and the current time.

$$d=s-\text{LAST_SEQ_CLOCK} \tag{16}$$

Next, in step S1704, the CPU 201 stores the current sequence clock interrupt count that was set to the variable s in step S1702 in the LAST_SEQ_CLOCK variable, as shown in equation (17) below, in order to prepare for the next time the automatic performance regulation process of step S1109 of FIG. 11 is executed.

$$\text{LAST_SEQ_CLOCK}=s \tag{17}$$

Next, the CPU 201 repeats the sequence of processes from steps S1705 to S1707 to execute a process that advances the automatic performance by the number of sequence clock interrupts that have occurred between the last time the automatic performance regulation process was executed and the current time, which was set to the variable d.

First, in step S1705 of this sequence, the CPU 201 determines whether the value of the variable d is 0 (that is, whether no sequence clock interrupts have occurred between the last time the automatic performance regulation process was executed and the current time, which was set to the variable d).

If the result of the determination in step S1705 is Yes, (that is, if the value of the variable d is 0 because no sequence clock interrupts have occurred between the last time the automatic performance regulation process was executed and the current time, which was set to the variable d), the CPU 201 immediately completes the automatic performance regulation process of step S1109 of FIG. 11 and illustrated in the flowchart in FIG. 17.

If the result of the determination in step S1705 is No, (that is, if the value of the variable d is not equal to 0 because a non-zero number of sequence clock interrupts have occurred between the last time the automatic performance regulation process was executed and the current time, which was then set to the variable d), the CPU 201 proceeds to step S1706 and executes the automatic performance control process, which advances the automatic performance process by an amount of time corresponding to one sequence clock interrupt. The automatic performance control process is a conventional technology, and therefore further details will be omitted here.

Next, in step S1707, the CPU 201 subtracts 1 from the sequence clock interrupt count set to the variable d. Then, the CPU 201 returns to the determination process in step S1705 and again determines whether the value of the variable d is 0. As long as the result of that determination is No, the CPU 201 repeatedly executes steps S1706 and S1707. When the result of the determination in step S1705 eventually becomes Yes, the CPU 201 completes the automatic performance regulation process of step S1109 of FIG. 11 and illustrated in the flowchart in FIG. 17.

The automatic performance regulation process described above makes it possible for the CPU 201 to advance the automatic performance by the number of sequence clock interrupts that have occurred between the last time the automatic performance regulation process was executed and the current time.

Figure 18:
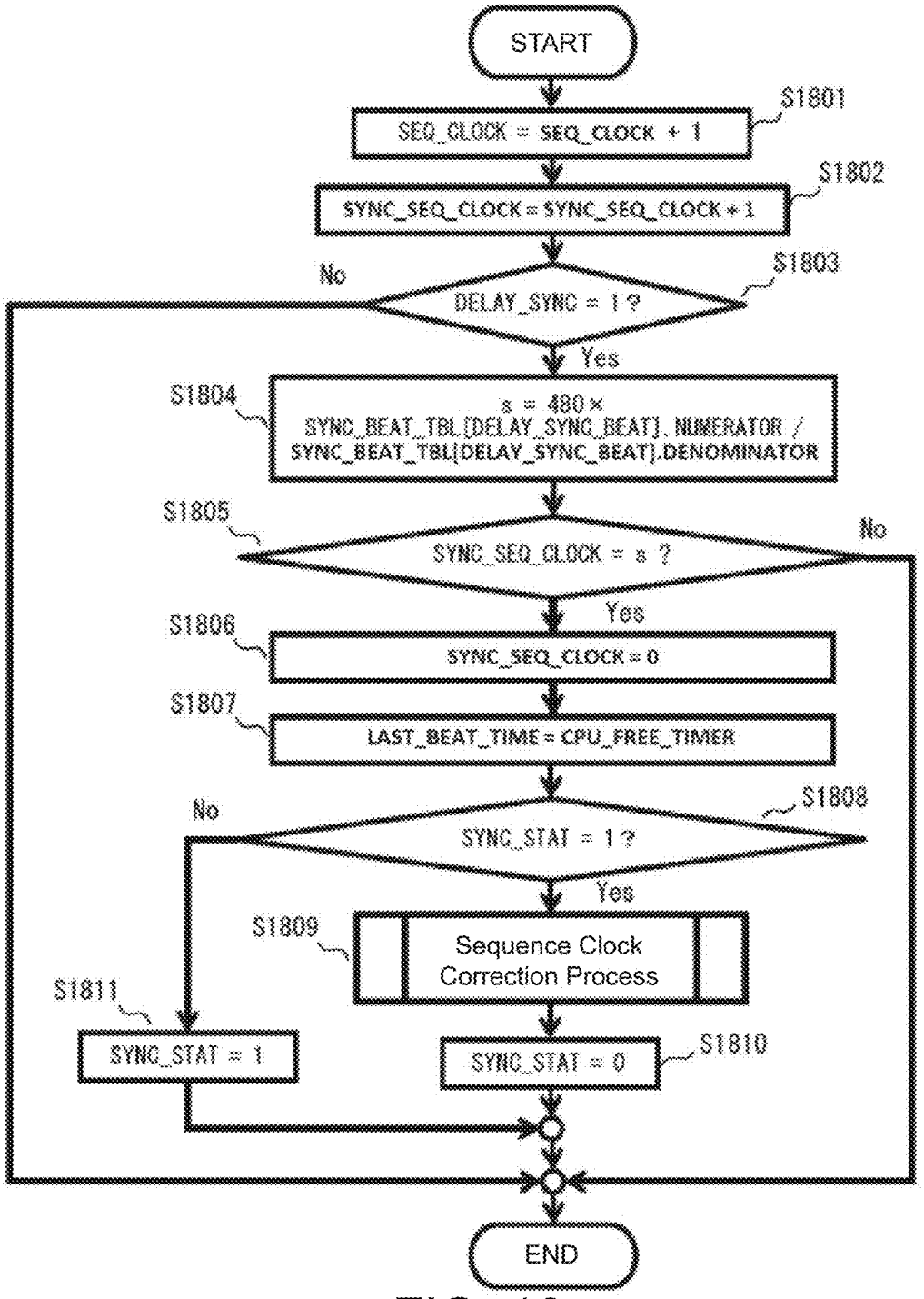
FIG. 18 is a flowchart illustrating an example of a sequence clock interrupt process.

FIG. 18 is a flowchart illustrating an example of a sequence clock interrupt process that the CPU 201 executes when the count of the sequence clock counter 301 in the CPU 201 reaches the maximum sequence clock count and a sequence clock interrupt is issued. In this process, the CPU 201 interrupts the electronic musical instrument control process illustrated in the flowcharts in FIGS. 11 to 17 and executes a sequence clock interrupt process program stored in the CPU ROM 202.

First, in step S1801, the CPU 201 increments (adds 1 to) the value of the total sequence clock interrupt count variable SEQ_CLOCK that indicates the total interrupt count of the sequence clock interrupts since the automatic performance started (see FIG. 9B).

Next, in step S1802, the CPU 201 increments (adds 1 to) the value of a per-delay time sequence clock interrupt count variable SYNC_SEQ_CLOCK that indicates the number of sequence clock interrupts that are counted for each delay time (see FIG. 9B). Note that later in step S1806 (described below), the value of this counter variable is reset to 0 if the result of a determination in step S1805 (in which it is detected whether this value is synchronized with the delay time; this step is described below) is Yes.

Next, in step S1803, the CPU 201 determines what value is set to the DELAY_SYNC variable.

If, in step S1803, the CPU 201 determines that the value set to the DELAY_SYNC variable is not 1 (that is, that delay tempo synchronization mode is currently disabled), the CPU 201 immediately completes the sequence clock interrupt process illustrated in the flowchart in FIG. 18 and resumes the electronic musical instrument control process illustrated in the flowcharts in FIGS. 11 to 17. In this case, the value of the total sequence clock interrupt count variable SEQ_CLOCK is incremented in step S1801 in accordance with the sequence clock interrupts, and the automatic performance is advanced by the automatic performance regulation process described above (in step S1109 of FIG. 11).

Meanwhile, if in step S1803 the CPU 201 determines that a value of 1 is set to the DELAY_SYNC variable (that is, that delay tempo synchronization mode is currently enabled), the CPU 201 proceeds to step S1804 and does the following. First, the CPU 201 accesses the SYNC_BEAT_TBL (FIG. 9A) stored in the CPU ROM 202 and uses the setting that was selected by the user with the BEAT knob in the DELAY area of the feature selection controls 102 illustrated in FIG. 1 and that was stored in the DELAY_SYNC_BEAT variable in the CPU RAM 203 to get the NUMERATOR value and the DENOMINATOR value from the entry that has the corresponding DELAY_SYNC_BEAT value (that is, the SYNC_BEAT_TBL(DELAY_SYNC_BEAT).NUMERATOR and SYNC_BEAT_TBL(DELAY_SYNC_BEAT).DENOMINATOR values, respectively). Then, the CPU 201 uses equation (18) below to set the variable s in the CPU RAM 203 to the sequence clock interrupt count value corresponding to the synchronization beat count corresponding to the setting that was specified by the user with the BEAT knob in the area in the DELAY region of the feature selection controls 102 illustrated in FIG. 1.

$$s=480\times\text{SYNC_BEAT_TBL(DELAY_SYNC_BEAT).NUMERATOR/SYNC_BEAT_TBL(DELAY_SYNC_BEAT).DENOMINATOR} \quad (18)$$

Next, in step S1805, the CPU 201 determines whether the value of the per-delay time sequence clock interrupt count variable SYNC_SEQ_CLOCK that is incremented in step S1802 each time a sequence clock interrupt occurs matches the sequence clock interrupt count value that corresponds to the synchronization beat count and was calculated and stored in the variable s in step S1804.

If the result of the determination in step S1805 is No, this means that the sequence clock interrupt count is not yet equal to the delay time setting. Therefore, the CPU 201 immediately completes the sequence clock interrupt process illustrated in the flowchart in FIG. 18 and resumes the electronic musical instrument control process illustrated in the flowcharts in FIGS. 11 to 17.

If the result of the determination in step S1805 is Yes, this means that the sequence clock interrupt count is equal to the delay time setting. Therefore, the CPU 201 proceeds to step S1806 and resets the value of the per-delay time sequence clock interrupt count variable SYNC_SEQ_CLOCK to 0 in preparation for the next delay time process.

Next, in step S1807, the CPU 201 sets the LAST_BEAT_TIME variable in the CPU RAM 203 to the value of the CPU_FREE_TIMER register in the CPU 201 (see FIG. 10A) that indicates the current value of the free-running timer counter 302 in the CPU 201 (see FIG. 3). This variable stores the instant or time at which the CPU 201 last determined that the number of sequence clock interrupts corresponding to the synchronization beat count that matches the delay time had been counted.

Next, in step S1808, the CPU 201 determines whether the value of a SYNC_STAT variable in the CPU RAM 203 is equal to 1. Here, the SYNC_STAT variable indicates whether a delay time interrupt corresponding to the current sequence clock interrupt was already issued from the DSP 206 at an earlier time. If the delay time interrupt corresponding to the current sequence clock interrupt occurred before the current sequence clock interrupt, then in a delay time interrupt process (described later), only a process for setting the instant or time at which the delay time interrupt occurred to the LAST_DELAY_TIME variable is executed (see step S1902 in FIG. 19). Moreover, the sequence clock correction process is not executed, and the delay time interrupt process is completed immediately after setting the value of the SYNC_STAT variable to 1 (see steps S1903 to S1906 in FIG. 19). Execution of the sequence clock correction process is then handled the next time the sequence clock interrupt process is executed. Meanwhile, if the current sequence clock interrupt occurred before the corresponding delay time interrupt, then the value of the SYNC_STAT variable remains equal to 0 after having been reset to 0 in the last sequence clock correction process (see step S1810 in FIG. 18 and step S1905 in FIG. 19).

Accordingly, if the result of the determination in step S1808 is Yes (that is, if the value of the SYNC_STAT variable is 1), this means that the delay time interrupt occurred first and the instant or time at which the delay time interrupt occurred is currently stored in the LAST_DELAY_TIME variable. Therefore, the CPU 201 proceeds to step S1809 and executes the sequence clock correction process. The details of this process will be described later with reference to the flowchart in FIG. 20.

Once the sequence clock correction process is complete, the CPU 201 proceeds to step S1810 and resets the value of the SYNC_STAT variable to 0. Then, the CPU 201 completes the current sequence clock interrupt process illustrated in the flowchart in FIG. 18 and resumes the electronic musical instrument control process illustrated in the flowcharts in FIGS. 11 to 17.

Figure 19:
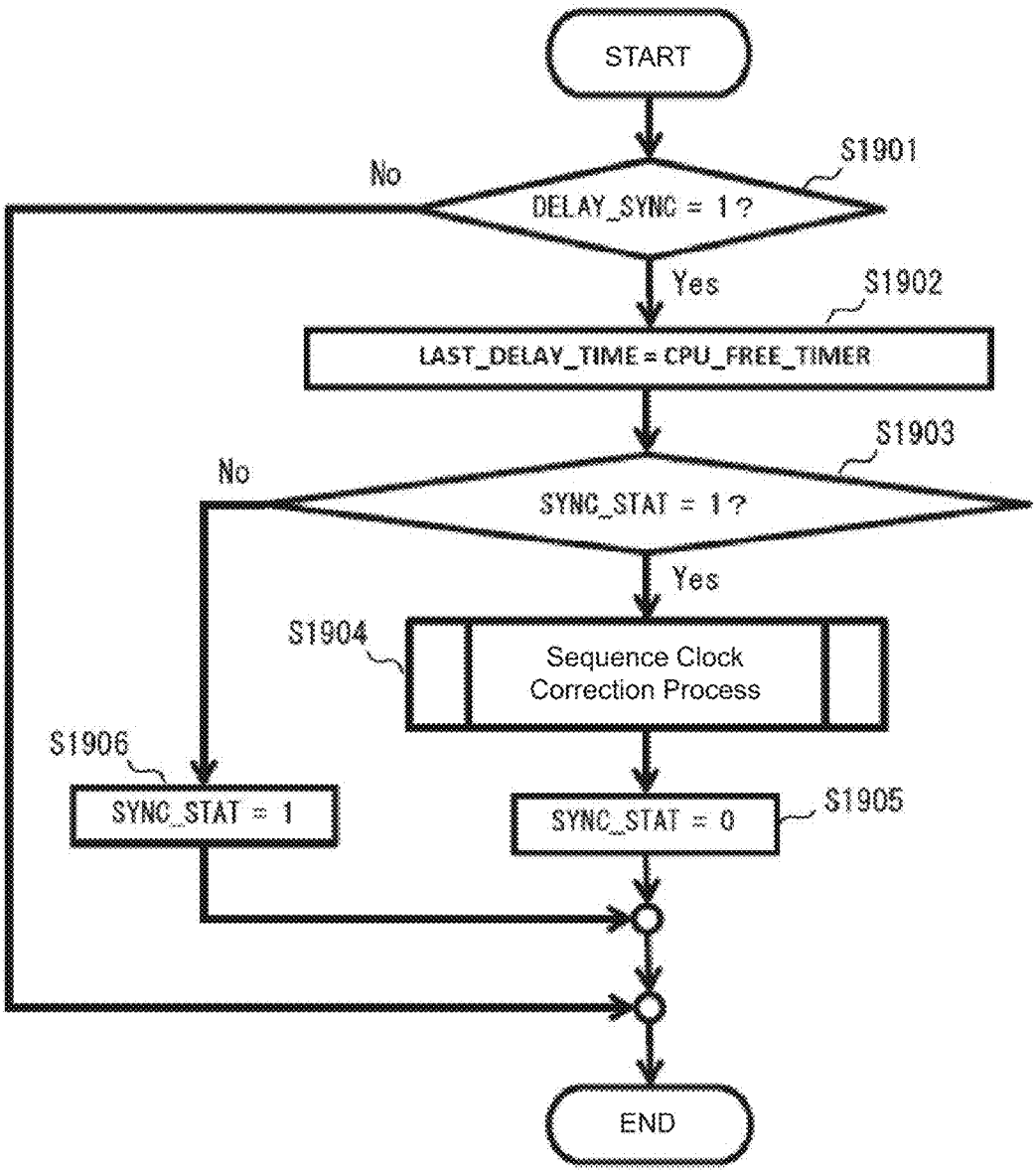
FIG. 19 is a flowchart illustrating an example of a delay time interrupt process.

Meanwhile, if the result of the determination in step S1808 is No (that is, if the value of the SYNC_STAT variable is 0), this means that the delay time interrupt corresponding to the current sequence clock interrupt process has not yet occurred. In this case, the CPU 201 proceeds to step S1811, sets the SYNC_STAT variable to a value of 1, and then completes the sequence clock interrupt process illustrated in the flowchart in FIG. 18 and resumes the electronic musical instrument control process illustrated in the flowcharts in FIGS. 11 to 17. In this way, when the delay time interrupt corresponding to the current sequence clock interrupt does occur, the value of the SYNC_STAT variable will be determined to be equal to 1, and the sequence clock correction process will be executed (that is, if the results of the determinations in steps S1901 through S1903 in FIG. 19 are Yes and the CPU 201 proceeds to step S1905). Moreover, in this case, even if the next sequence clock interrupt occurs before the delay time interrupt corresponding to the current sequence clock interrupt and the process in the flowchart in FIG. 18 is executed again, the value of the SYNC_SEQ_CLOCK variable will have been reset to 0 in step S1806. Therefore, if the result of the determination in steps S1801 through S1803 is Yes and the CPU 201 proceeds to step S1804, the result of the determination in step S1805 will be No. This ensures that the sequence clock correction process of step S1809 will not be executed on the basis of the next sequence clock interrupt before the delay time interrupt corresponding to the current sequence clock interrupt occurs.

FIG. 19 is a flowchart illustrating an example of the delay time interrupt process that the CPU 201 executes when the count of the delay time counter 601 in the DSP 206 reaches the delay time sampling count 608 (see FIG. 6) and a delay time interrupt is issued. In this process, the CPU 201 interrupts the electronic musical instrument control process illustrated in the flowcharts in FIGS. 11 to 17 and executes a delay time interrupt process program stored in the CPU ROM 202.

First, in step S1901, the CPU 201 determines what value is set to the DELAY_SYNC variable.

If, in step S1901, the CPU 201 determines that the value set to the DELAY_SYNC variable is not 1 (that is, that delay tempo synchronization mode is currently disabled), the CPU 201 immediately completes the sequence clock interrupt process illustrated in the flowchart in FIG. 19 and resumes the electronic musical instrument control process illustrated in the flowcharts in FIGS. 11 to 17.

Meanwhile, if in step S1901 the CPU 201 determines that a value of 1 is set to the DELAY_SYNC variable (that is, that delay tempo synchronization mode is currently enabled), the CPU 201 proceeds to step S1902 and sets the LAST_DELAY_TIME variable in the CPU RAM 203 to the value of the CPU_FREE_TIMER register in the CPU 201 (see FIG. 10A) that indicates the current value of the free-running timer counter 302 in the CPU 201 (see FIG. 3). This variable stores the instant or time at which the DSP 206 last issued a delay time interrupt.

Next, in step S1903, the CPU 201 determines whether the value of a SYNC_STAT variable in the CPU RAM 203 is equal to 1. In the delay time interrupt process, the SYNC_STAT variable indicates whether the number of sequence clock interrupts corresponding to the synchronization beat count corresponding to the current delay time interrupt were already issued at an earlier time. If the number of sequence clock interrupts corresponding to the synchronization beat count corresponding to the current delay time interrupt occurred before the current delay time interrupt, then in the sequence clock interrupt process described above, only the process for setting the instant or time at which that number of sequence clock interrupts occurred to the LAST_BEAT_TIME variable is executed (see step S1807 in FIG. 18). Moreover, the sequence clock correction process is not executed, and the sequence clock interrupt process is completed immediately after setting the value of the SYNC_STAT variable to 1 (see steps S1808 to S1811 in FIG. 18). Execution of the sequence clock correction process is then handled the next time the delay time interrupt process is executed. Meanwhile, if the current delay time interrupt occurred before the corresponding number of sequence clock interrupts corresponding to the synchronization beat count, then the value of the SYNC_STAT variable remains equal to 0 after having been reset to 0 in the last sequence clock correction process (see step S1810 in FIG. 18 and step S1905 in FIG. 19).

Accordingly, if the result of the determination in step S1903 is Yes (that is, if the value of the SYNC_STAT variable is 1), this means that the number of sequence clock interrupts corresponding to the synchronization beat count occurred first and the instant or time at which that number of sequence clock interrupts occurred is currently stored in the LAST_BEAT_TIME variable. Therefore, the CPU 201 proceeds to step S1904 and executes the sequence clock correction process. The details of this process will be described later with reference to the flowchart in FIG. 20.

Once the sequence clock correction process is complete, the CPU 201 proceeds to step S1905 and resets the value of the SYNC_STAT variable to 0. Then, the CPU 201 completes the current delay time interrupt process illustrated in the flowchart in FIG. 19 and resumes the electronic musical instrument control process illustrated in the flowcharts in FIGS. 11 to 17.

Meanwhile, if the result of the determination in step S1903 is No (that is, if the value of the SYNC_STAT variable is 0), this means that the number of sequence clock interrupts corresponding to the synchronization beat count corresponding to the current delay time interrupt have not yet occurred. In this case, the CPU 201 proceeds to step S1906, sets the SYNC_STAT variable to a value of 1, and then completes the delay time interrupt process illustrated in the flowchart in FIG. 19 and resumes the electronic musical instrument control process illustrated in the flowcharts in FIGS. 11 to 17. In this way, once the number of sequence clock interrupts corresponding to the synchronization beat count corresponding to the current delay time interrupt do occur, the value of the SYNC_STAT variable will be determined to be equal to 1, and the sequence clock correction process will be executed (that is, if the result of the determination in step S1808 in FIG. 18 is Yes and the CPU 201 proceeds to step S1809). Moreover, in this case, even if another sequence clock interrupt occurs before the current delay time interrupt and the process in the flowchart in FIG. 18 is executed again, the value of the SYNC_SEQ_CLOCK variable will have been reset to 0 in step S1806. Therefore, if the result of the determination in steps S1801 through S1803 is Yes and the CPU 201 proceeds to step S1804, the result of the determination in step S1805 will be No. This ensures that from a timing perspective, it is not possible for the next delay time interrupt to occur and the sequence clock correction process of step S1905 to be executed before the number of sequence clock interrupts corresponding to the synchronization beat count corresponding to the current delay time interrupt occur.

Figure 20:
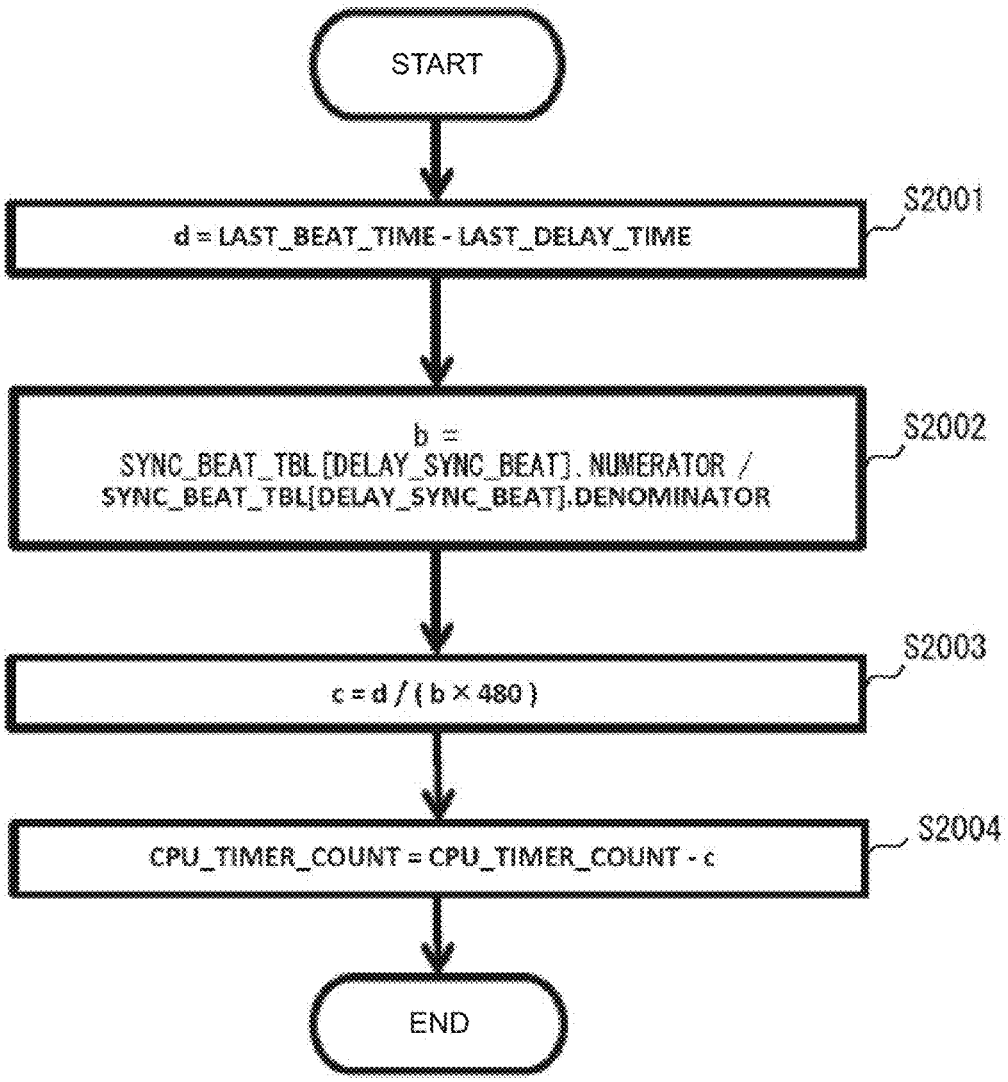
FIG. 20 is a flowchart illustrating a detailed example of a sequence clock correction process.

FIG. 20 is a flowchart illustrating a detailed example of the sequence clock correction process of step S1809 in FIG. 18 and step S1904 in FIG. 19. The sequence clock correction process is executed on the basis of the principles described above and in reference to equations (7) to (10).

First, in step S2001, the CPU 201 measures the time difference d between the instant or time at which the number of sequence clock interrupts corresponding to the current synchronization beat count occurred (which was set to the LAST_BEAT_TIME variable in step S1807 of FIG. 18) and the instant or time at which the current delay time interrupt occurred (which was set to the LAST_DELAY_TIME variable in step S1902 of FIG. 19).

Next, in step S2002, the CPU 201 accesses the SYNC_BEAT_TBL (FIG. 9A) stored in the CPU ROM 202 and uses the setting that was selected by the user with the BEAT knob in the DELAY area of the feature selection controls 102 illustrated in FIG. 1 and that was stored in the DELAY_SYNC_BEAT variable in the CPU RAM 203 to get the NUMERATOR value and the DENOMINATOR value from the entry that has the corresponding DELAY_SYNC_BEAT value (that is, the SYNC_BEAT_TBL(DELAY_SYNC_BEAT).NUMERATOR and SYNC_BEAT_TBL(DELAY_SYNC_BEAT).DENOMINATOR values, respectively). Then, using this NUMERATOR value and DENOMINATOR value, the CPU 201 uses equation (19) below (which corresponds to equation (7)) to calculate the synchronization beat count b corresponding to the setting that the user specified with the BEAT knob.

$$b=\text{SYNC_BEAT_TBL(DELAY_SYNC_BEAT).NUMERATOR/SYNC_BEAT_TBL(DELAY_SYNC_BEAT).DENOMINATOR} \quad (19)$$

Next, in step S2003, the CPU 201 uses the time difference d calculated in step S2001, the synchronization beat count b calculated in step S2002, and equation (10) to calculate the correction c for the maximum sequence clock count. The second count value (which determines the playback speed of the musical notes of the automatic performance, which is determined by counting the sequence clock to the second count value) is changed on the basis of this correction. This makes it possible to change the playback speed of the musical notes of the automatic performance in accordance with the timing at which the audio effect sound is emitted (which is determined by counting the sampling clock to the first count value).

Next, in step S2004, the CPU 201 updates the maximum sequence clock count by subtracting the correction c calculated in step S2003 from the maximum sequence clock count that is currently set to the sequence clock counter 301 (FIG. 3) and to the CPU_TIMER_COUNT register in the CPU 201 (see FIG. 10A), and then setting the new maximum sequence clock count back to the CPU_TIMER_COUNT register. Recall that the value of the CPU_TIMER_COUNT register is set in step S1203 of the initialization process of step S1101 in FIG. 11 or in step S1306 in FIG. 13 as part of the tempo configuration process of step S1104 of FIG. 11.

$$\text{CPU_TIMER_COUNT}=\text{CPU_TIMER_COUNT}-c \quad (20)$$

Therefore, in the next delay process, the shift between the timing of the automatic performance (which is advanced by an amount equal to the delay time in terms of the sequence clock interrupts in the CPU 201) and the timing of the delay process (which has a length equal to the delay time in the DSP 206) will be removed.

The present embodiment as described above has a configuration in which a delay process is executed to apply an echo effect to an audio signal as an audio effect. However, the present invention is not limited to this type of audio effect. For example, the present invention may also be configured to execute a process that generates a low-frequency oscillation (LFO) for applying at least one of a vibrato effect and a tremolo effect to an audio signal.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. An audio processing device, comprising:

a first processor that cyclically counts a sampling clock to a first count value, and outputs an audio effect sound generated by processing a received audio waveform signal each time the count of the sampling clock reaches the first count value; and a second processor that cyclically counts a sequence clock to a second count value, and causes a corresponding segment of a preset music to be played each time the count of the sequence clock reaches the second count value so as to perform an automatic play of the preset music, wherein each time the count of the sampling clock reaches the first value, the first or second processor, or a separate circuit unit in the audio processing device detects a time difference between a time at which the count of the sampling clock reaches the first count value and a time at which the count of the sequence clock reaches the second count value a number of times corresponding to said time at which the count of the sampling clock reaches the first count value, and adjusts the second count value for a subsequent cycle of counting in accordance with the detected time difference so as to reduce the detected time difference, thereby providing synchronization of the output of the audio effect sound with the automatic play of the preset music over time.

2. The audio processing device according to claim 1, further comprising:

a first clock generator that generates the sampling clock; and a second clock generator that generates the sequence clock.

3. The audio processing device according to claim 1, wherein the first processor includes a first counter that counts the sampling clock, and wherein the second processor includes a second counter that counts the sequence clock.

4. The audio processing device according to claim 1, further comprising:

a tempo specification unit that specifies a tempo for the automatic play, wherein the first count value and the second count value are determined in accordance with the tempo that is specified.

5. The audio processing device according to claim 1, further comprising:

a table that stores the first count value and the second count value corresponding to each tempo of a plurality of tempos for the automatic play, wherein the second processor causes the first count value and the second count value corresponding to the tempo specified for the automatic play to be read from the table, and then causes the first count value that has been read out from the table to be set in the first processor.

6. The audio processing device according to claim 1, wherein the first processor outputs the audio effect sound generated by processing the received audio waveform signal each time the count of the sampling clock reaches the first count value only when the first processor receives the audio waveform signal at a timing corresponding to a time equal to a prescribed natural number multiple or a prescribed natural number fraction of a time interval determined by counting the sampling clock to the first count value.

7. The audio processing device according to claim 1, wherein the first processor processes the received audio waveform signal to output said audio effect sound each time the count of the sampling clock reaches the first count value such that said audio effect sounds produce a digital delay effect in which an echo effect is applied to a sound of the audio waveform signal.

8. The audio processing device according to claim 1, wherein the first processor processes the received audio waveform signal to output said audio effect sound each time the count of the sampling clock reaches the first count value such that said audio effect sounds produce a low-frequency oscillation effect on the received audio waveform, thereby creating a vibrato or tremolo effect on a sound of the audio waveform signal.

9. A method of audio processing used in an audio processing device having a first processor and a second processor, the method comprising:

causing the first processor to:

cyclically count a sampling clock to a first count value, and output an audio effect sound generated by processing a received audio waveform signal each time the count of the sampling clock reaches the first count value;

causing the second processor to:

cyclically count a sequence clock to a second count value, and cause a corresponding segment of a preset music to be played each time the count of the sequence clock reaches the second count value so as to perform an automatic play of the preset music; and each time the count of the sampling clock reaches the first value, causing the first or second processor, or a separate circuit unit in the audio processing device to:

detect a time difference between a time at which the count of the sampling clock reaches the first count value and a time at which the count of the sequence clock reaches the second count value a number of times corresponding to said time at which the count of the sampling clock reaches the first count value, and adjust the second count value for a subsequent cycle of counting in accordance with the detected time difference so as to reduce the detected time difference, thereby providing synchronization of the output of the audio effect sound with the automatic play of the preset music over time.

10. A non-transitory computer-readable storage medium having stored therein a program executable by an audio processing device having a first processor operating under a sampling clock and a second processor operating under a sequential clock, the program controlling the audio processing device to perform the following:

causing the first processor to:

cyclically count the sampling clock to a first count value, and output an audio effect sound generated by processing a received audio waveform signal each time the count of the sampling clock reaches the first count value;

causing the second processor to:

cyclically count the sequence clock to a second count value, and cause a corresponding segment of a preset music to be played each time the count of the sequence clock reaches the second count value so as to perform an automatic play of the preset music; and each time the count of the sampling clock reaches the first value, causing the first or second processor, or a separate circuit unit in the audio processing device to:

detect a time difference between a time at which the count of the sampling clock reaches the first count value and a time at which the count of the sequence clock reaches the second count value a number of times corresponding to said time at which the count of the sampling clock reaches the first count value, and adjust the second count value for a subsequent cycle of counting in accordance with the detected time difference so as to reduce the detected time difference, thereby providing synchronization of the output of the audio effect sound with the automatic play of the preset music over time.

11. An electronic musical instrument, comprising:

the audio processing device according to claim 1;

musical controls that specify a pitch of a musical note to be played; and a waveform generator that generates a waveform signal representing a musical note having the pitch specified by the musical controls as said audio waveform signal, and supplies said audio waveform signal to the first processor.

12. An electronic musical instrument, comprising:

a sound emitting unit that receives an audio waveform signal supplied from an input unit and repeatedly emits, at a prescribed timing, an audio effect sound generated by processing the audio waveform signal, the sound emitting unit further outputting musical notes of a preset music stored in a storage unit to perform an automatic play of the preset music; and a controller that changes, in accordance with said prescribed timing at which the audio effect sound is emitted by the sound emitting unit, playback timing and speed of the automatic play of the preset music by the sound emitting unit.

13. The electronic musical instrument according to claim 12, further comprising:

a first counter; and a second counter, wherein the controller further performs the following:

causing the first counter to count a first clock to a first count value to determine said prescribed timing at which the audio effect sound is repeatedly emitted;

causing the second counter to count a second clock to a second count value to determine the playback timing and speed of the automatic play of the preset music;

comparing a timing at which the first counter reaches the first count value and a timing at which the second counter reaches the second count value a number of times corresponding to said timing at which the first counter reaches the first count value so as to detect non-synchronization between said prescribed timing at which the audio effect sound is repeatedly emitted and beat timings of the preset music automatically played by the sound emitting unit;

deriving a correction value for the second count value based on a result of the comparison; and changing the second count value in accordance with the derived correction value so that the playback timing and speed of the automatic play of the preset music are adjusted such that the beat timings of the preset music automatically played are in synchronization with said prescribed timing at which the audio effect sound is repeatedly emitted.

14. The electronic musical instrument according to claim 12, wherein the input unit includes any of a keyboard, feature selection controls, tone selection buttons, and bender/modulation wheels.

* * * * *